US012017126B2

(12) United States Patent
Boisture

(10) Patent No.: US 12,017,126 B2
(45) **Date of Patent: *Jun. 25, 2024**

(54) TACKLING APPARATUS WITH WEIGHT STACK

(71) Applicant: Athletic Technologies LLC, Grand Blanc, MI (US)

(72) Inventor: Martin Boisture, Grand Blanc, MI (US)

(73) Assignee: Athletic Technologies LLC, Grand Blanc, MI (US)

( * ) Notice: Subject to any disclaimer, the term of this patent is extended or adjusted under 35 U.S.C. 154(b) by 151 days.

This patent is subject to a terminal disclaimer.

(21) Appl. No.: 17/711,221

(22) Filed: Apr. 1, 2022

(65) Prior Publication Data

US 2022/0323845 A1 Oct. 13, 2022

Related U.S. Application Data

(60) Provisional application No. 63/170,078, filed on Apr. 2, 2021.

(51) Int. Cl.
*A63B 69/34* (2006.01)
*A63B 21/00* (2006.01)
(Continued)

(52) U.S. Cl.
CPC ..... *A63B 69/34* (2013.01); *A63B 21/0628* (2015.10); *A63B 21/154* (2013.01);
(Continued)

(58) Field of Classification Search
CPC . A63B 21/0628; A63B 21/154; A63B 71/023; A63B 2225/093; A63B 2243/0066
(Continued)

(56) References Cited

U.S. PATENT DOCUMENTS 650,008 A 5/1900 Hamel
704,265 A 7/1902 McMaster
(Continued)

FOREIGN PATENT DOCUMENTS

WO WO-0137950 A1 5/2001
WO WO-2010122540 A2 10/2010

OTHER PUBLICATIONS

Penning, Craig, "evader tackling machine!" YouTube, Aug. 28, 2011, https://www.youtube.com/watch?v=a-mdJXIm4eY.
(Continued)

*Primary Examiner* — Mitra Aryanpour
(74) *Attorney, Agent, or Firm* — Harness, Dickey & Pierce, P.L.C.

(57) ABSTRACT

An apparatus includes a pair of support members, a cable, a rolling mechanism, a tackling bag and a pulley device. The pair of support members are fixedly coupled to a surface. The cable is attached to and extends between the pair of support members. The rolling mechanism is connected to the cable and configured to traverse the cable from a first end of the cable toward a second end of the cable. The tackling bag is attached to the rolling mechanism and configured to be propelled from one of the pair of support members toward the other of the pair of support members. The cable passes through a pulley system which is couple to a stack of weights. When the tackling bag is tackled, the stack of weights provide resistance to the tackler.

19 Claims, 17 Drawing Sheets

(51) Int. Cl.
*A63B 21/062* (2006.01)
*A63B 71/02* (2006.01)

(52) U.S. Cl.
CPC ..... *A63B 71/023* (2013.01); *A63B 2209/08* (2013.01); *A63B 2225/093* (2013.01); *A63B 2243/0066* (2013.01); *A63B 2243/007* (2013.01)

(58) Field of Classification Search
USPC ..... 473/443, 445
See application file for complete search history.

(56) References Cited

U.S. PATENT DOCUMENTS

| | | | | |
|---|---|---|---|---|
| 1,204,017 | A | 11/1916 | Hinky | |
| 1,538,203 | A | 5/1925 | Moran | |
| 1,817,364 | A | 8/1931 | Goldsmith | |
| 1,909,461 | A | 5/1933 | Costa | |
| 2,153,384 | A | 4/1939 | Mazza | |
| 2,183,465 | A | 12/1939 | Noor | |
| 2,255,711 | A | 9/1941 | Noor | |
| 2,290,297 | A | 7/1942 | Smith | |
| 2,344,829 | A | 3/1944 | McAvoy | |
| 2,749,121 | A | 6/1956 | Myers | |
| 3,114,549 | A | 12/1963 | Hooker | |
| 3,140,874 | A | 7/1964 | Jensen et al. | |
| 3,337,217 | A | 8/1967 | Cummins | |
| 3,424,458 | A | 1/1969 | Hopps, Jr. | |
| 3,637,210 | A | 1/1972 | Brantley | |
| 3,659,847 | A | 5/1972 | Gow | |
| 3,659,848 | A | 5/1972 | DePew | |
| 3,836,147 | A | 9/1974 | Shapiro | |
| 5,688,196 | A | 11/1997 | O'Neil | |
| 5,897,466 | A | 4/1999 | Capach | |
| 6,050,906 | A | 4/2000 | Stout et al. | |
| 6,375,584 | B1 | 4/2002 | Shapiro | |
| 7,736,248 | B2 | 6/2010 | Eldridge | |
| 8,790,198 | B1 | 7/2014 | Russell | |
| 8,808,115 | B2 | 8/2014 | DeTroia | |
| 9,879,949 | B2 | 1/2018 | Roemer | |
| 10,661,141 | B1 | 5/2020 | Boisture | |
| 11,213,734 | B2 * | 1/2022 | Boisture | A63B 69/32 473/443 |
| 11,235,221 | B2 * | 2/2022 | Boisture | A63B 69/34 473/443 |
| 11,691,062 | B2 * | 7/2023 | Boisture | A63B 69/34 473/443 |
| 2008/0280703 | A1 | 11/2008 | Eldridge | |
| 2012/0309565 | A1 | 12/2012 | Ponstein | |
| 2020/0269116 | A1 * | 8/2020 | Boisture | A63B 69/34 473/443 |
| 2021/0245028 | A1 * | 8/2021 | Boisture | A63B 69/305 473/443 |
| 2022/0118335 | A1 * | 4/2022 | Boisture | A63B 69/244 473/443 |
| 2022/0143482 | A1 * | 5/2022 | Boisture | A63B 71/023 473/443 |
| 2022/0323845 | A1 * | 10/2022 | Boisture | A63B 21/154 473/443 |

OTHER PUBLICATIONS

International Search Report regarding International Application No. PCT/US2020/020093, dated Jun. 23, 2020.
Written Opinion regarding International Application No. PCT/US2020/020093, dated Jun. 23, 2020.
International Search Report and Written Opinion regarding International Application No. PCT/US2021/017499, dated Jun. 7, 2021.
International Preliminary Report on Patentability regarding International Patent Application No. PCT/US2020/020093, dated Aug. 25, 2021.

* cited by examiner

TACKLING APPARATUS WITH WEIGHT STACK

CROSS-REFERENCE TO RELATED APPLICATIONS

This application claims the benefit of U.S. Provisional Application No. 63/170,078, filed on Apr. 2, 2021. The entire disclosure of the above application is incorporated herein by reference.

FIELD

The present disclosure relates to a tackling apparatus.

BACKGROUND

This section provides background information related to the present disclosure and is not necessarily prior art.

Football (i.e., American Football) or rugby, for example, involves substantial player on player physical contact. As is known, player on player physical contact may result in injuries and repeated contact during practice may elevate the risk of player injury. As such, player on player contact during practice has been limited (or prevented altogether).

As a result of limited player on player physical contact during practice, tackling apparatuses (e.g., a tackling dummy) are used to teach players proper tackling techniques and form without the need for player on player physical contact. However, such tackling apparatuses are not reliable and do not accurately simulate live game tackling. The present disclosure provides a tackling apparatus that is reliable and accurate simulates live game tackling.

SUMMARY

This section provides a general summary of the disclosure, and is not a comprehensive disclosure of its full scope or all of its features.

In one form, the present disclosure provides an apparatus that includes a pair of support members, a cable, a rolling mechanism, a tackling bag, a pulley system, and a stack of weights. The pair of support members are fixedly coupled to a surface. The cable extends between the pair of support members. The rolling mechanism is configured to traverse the cable from a first end of the cable toward a second end of the cable. The tackling bag is configured to be propelled from one of the pair of support members toward the other of the pair of support members. The tackling bag also is configured to be tackled when propelled from the one of the pair of support members toward the other of the pair of support members. The pulley system is associated with the first support member of the pair of support members and includes a first pulley device and a second pulley device. At least one of the first and second pulley devices comprises a plurality of sheaves and the first cable extends around the first and second pulley devices and through each sheave of the plurality of sheaves. The stack of weights is attached to the pulley system. At least a portion of the rolling mechanism is permitted to move downwardly relative to the cable when a force is applied to the tackling bag. The stack of weights is configured to provide resistance to a force applied on the tackling bag and move in a vertical direction when the force is applied on the tackling bag.

In some configurations of the apparatus of the above paragraph, the first pulley device is coupled to the first support member of the pair of support members and the second pulley device is coupled to the stack of weights.

In some configurations of the apparatus of any one or more of the above paragraphs, the cable includes a first end fixed to the first support member of the pair of support members and a second end opposing the first end fixed to the second support member of the pair of support members.

In some configurations of the apparatus of any one or more of the above paragraphs, the first end of the cable includes a turnbuckle configured to adjust an amount of tension of the cable.

In some configurations of the apparatus of any one or more of the above paragraphs, the apparatus further includes comprising a second cable including a first end coupled to the first support member of the pair of support members and a second end coupled to the second of the pair of support members. The rolling mechanism includes a first wheel housing, a second wheel housing, and a traveling pulley device. The first wheel housing includes a first set of wheels rotatably coupled thereto where the second cable extends between two wheels of the first set of wheels. The second wheel housing includes a second set of wheels rotatably coupled thereto where the second cable extends between two wheels of the second set of wheels. The traveling pulley device is removably coupled to at least one of the first wheel housing and the second wheel housing. The rolling mechanism is configured to traverse second cable from the first end of the second cable to the second end of the second cable.

In some configurations of the apparatus of any one or more of the above paragraphs, a portion of the first cable moves downwardly in a vertical direction relative to the second cable when the force is applied to the tackling bag.

In some configurations of the apparatus of any one or more of the above paragraphs, the traveling pulley device is separated from the rolling mechanism when the force is applied to the tackling bag.

In some configurations of the apparatus of any one or more of the above paragraphs, the rolling mechanism further includes a third wheel housing having a first wheel assembly and a second wheel assembly. A wheel of the first wheel assembly is rotatably coupled to the third wheel housing and a wheel of the second wheel assembly is rotatably coupled to the third wheel housing. The second cable extends through the first wheel assembly and the second wheel assembly.

In some configurations of the apparatus of any one or more of the above paragraphs, a portion of the first cable moves downwardly in a vertical direction relative to the second cable when the force is applied to the tackling bag.

In some configurations of the apparatus of any one or more of the above paragraphs, the traveling pulley device is separated from the rolling mechanism when the force is applied to the tackling bag.

In another form, the present disclosure provides an apparatus that includes a pair of support members, a first cable, a second cable, a third cable, a rolling mechanism, and a tackling bag. The pair of support members are fixedly coupled to a surface. The first cable is attached to and extends between the pair of support members. The second cable extends between the pair of support members. The third cable is attached to and extends between the pair of support members. The rolling mechanism includes a first wheel housing which includes a first wheel assembly including a first wheel rotatably coupled thereto. The tackling bag is attached to the rolling mechanism and is configured to be propelled from a first support member of the pair of support members toward a second support member of the pair of support members. The tackling bag is also configured to be tackled when propelled from the first support member of the pair of support members toward the second support member of the pair of support members. The rolling rolling mechanism is configured to traverse the first, second, and third cables from a first end of the first, second, and third cables toward a second end of the first, second cable, and third cables. At least a portion of the rolling mechanism is permitted to move downwardly relative to the first cable when a force is applied to the tackling bag. The first wheel is configured to remain atop the third cable when the force is applied to the tackling bag.

In some configurations of the apparatus of the above paragraph, the rolling mechanism also includes a second wheel housing, a third wheel housing, and a traveling pulley device. The second wheel housing includes a first set of wheels rotatably coupled thereto wherein the second cable extends between two wheels of the first set of wheels. The third wheel housing includes a second set of wheels rotatably coupled thereto wherein the second cable extends between two wheels of the second set of wheels. The first wheel housing is attached to at least one of the second and third wheel housings and is configured to traverse the first cable and the third cable. The traveling pulley device is removably coupled to at least one of the first wheel housing and the second wheel housing. The second and third wheel housings and the traveling pulley device are configured to traverse the second cable.

In some configurations of the apparatus of any one or more of the above paragraphs, the first wheel housing further includes a second wheel assembly and a third wheel assembly. A wheel of the second wheel assembly is rotatably coupled to the first wheel housing and a wheel of the third wheel assembly is rotatably coupled to the first wheel housing. The second cable extends through the second wheel assembly and the third wheel assembly.

In some configurations of the apparatus of any one or more of the above paragraphs, the traveling pulley device is configured to move downwardly relative to the first cable when the force is applied to the tackling bag.

In some configurations of the apparatus of any one or more of the above paragraphs, the traveling pulley device is positioned between the second and third wheel housings.

In some configurations of the apparatus of any one or more of the above paragraphs, the apparatus further includes a magnet coupled to the rolling mechanism and the rolling mechanism further includes a metallic plate attached to the traveling pulley device. The magnet and the metallic plate are attached to each other thereby causing the traveling pulley device to be separated from the second cable.

In some configurations of the apparatus of any one or more of the above paragraphs, the magnet is coupled to at least one of the second and third wheel housings of the rolling mechanism.

In some configurations of the apparatus of any one or more of the above paragraphs, the force applied to the tackling bag causes the metallic plate and the magnet to detach from each other.

In some configurations of the apparatus of any one or more of the above paragraphs, the first end of the first cable is fixed to the first support member of the pair of support members at a higher point than the second end of the first cable is fixed to the second support member of the pair of support members and the first end of the third cable is fixed to the first support member of the pair of support members at a higher point than the second end of the third cable is fixed to the second support member of the pair of support members.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
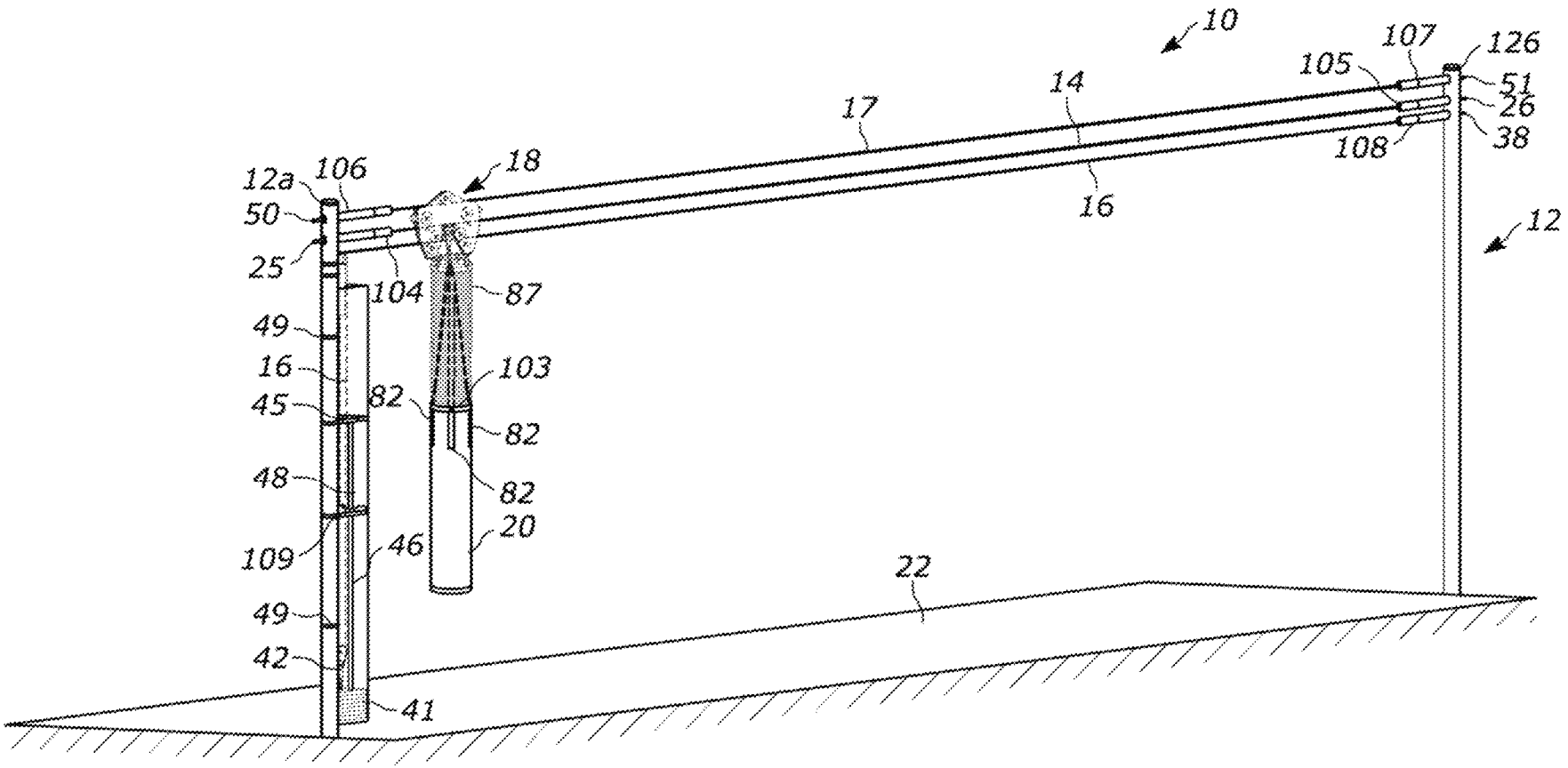
FIG. 1 is a perspective view of a tackling apparatus according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
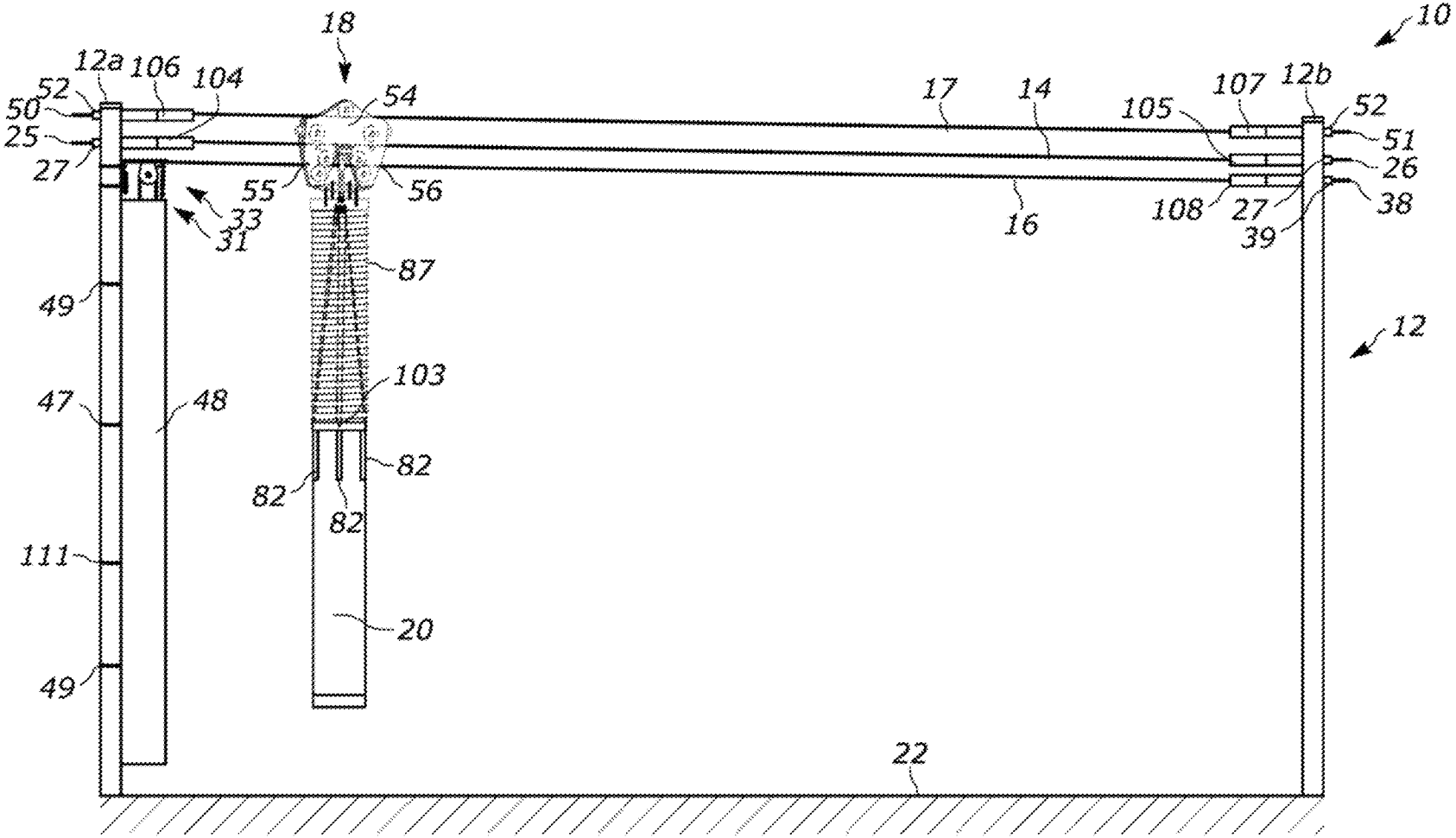
FIG. 2 is a front view of the tackling apparatus shown in FIG. 1 prior to a tackling bag of the tackling apparatus being propelled and tackled.

As shown in FIGS. 1 and 2, an apparatus 10 is provided that may include a pair of elongated support structures or members 12 (comprised of support member 12*a* and support member 12*b*), first, second, and third cables 14, 16, 17, a trolley or rolling mechanism 18, and an elongated tackling bag or body 20.

The pair of support members 12 may be fixedly coupled to a surface 22 or an adjacent wall or beam (not shown), and may be aligned with each other. The pair of support members 12 may be supported by a pair of support cables (not shown), extending from an upper portion of a support member 12*a*, 12*b* to the surface 22. Each support member 12*a*, 12*b* may be cylindrically-shaped (as shown in FIGS. 1-7) and may be made of a metallic material, for example. In some configurations, each support member 12*a*, 12*b* may be rectangular prism-shaped (such as the configuration shown in FIGS. 8 and 9) or another suitable shape. A height of the pair of support members 12 may be the same for each support member 12*a*, 12*b*, or may vary, as is shown in FIG. 2. In some configurations, the pair of support members 12 may be telescoping such that a height that the tackling bag 20 is suspended above the surface 22, when the surface may be adjustable.

As shown in FIGS. 1 and 2, the first cable 14 may extend between the pair of support members 12 and may support the rolling mechanism 18. The first cable 14 may be rigid. With reference to FIGS. 1-7, a first end 25 of the first cable 14 may extend through an aperture (not shown) of the support member 12*a* (FIGS. 1-4 and 7) and a second end 26 of the first cable 14 may extend through an aperture (not shown) of the support member 12*b* (FIGS. 1, 2, 5 and 6). A fastening member 27 (e.g., locking nut or eye-bolt) may be secured to the first and second ends 25, 26 of the first cable 14 to attach the first cable 14 to the pair of support members 12.

Figure 9:
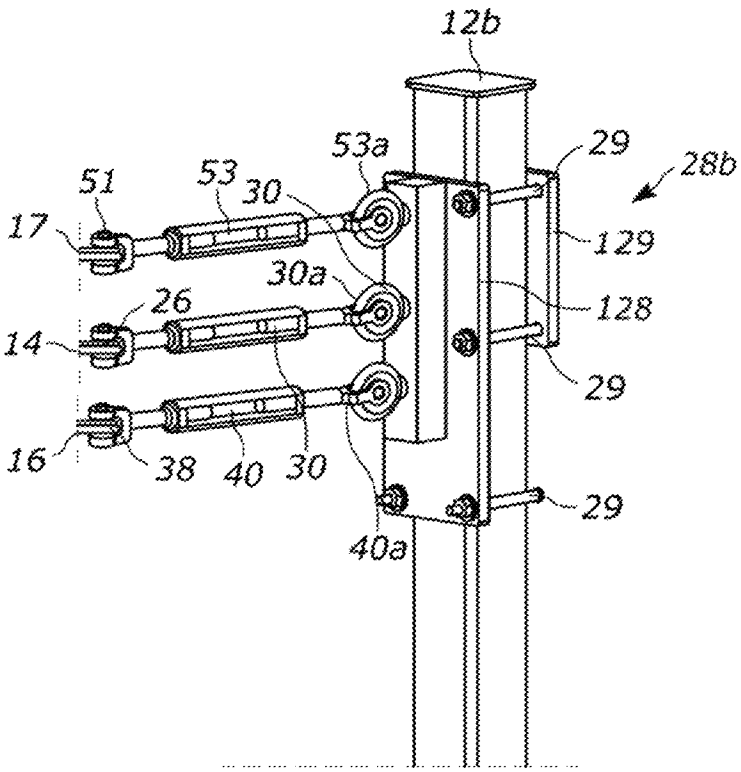
FIG. 9 is a partial perspective view of a second support member with an adjustment bracket.
Figure 8:
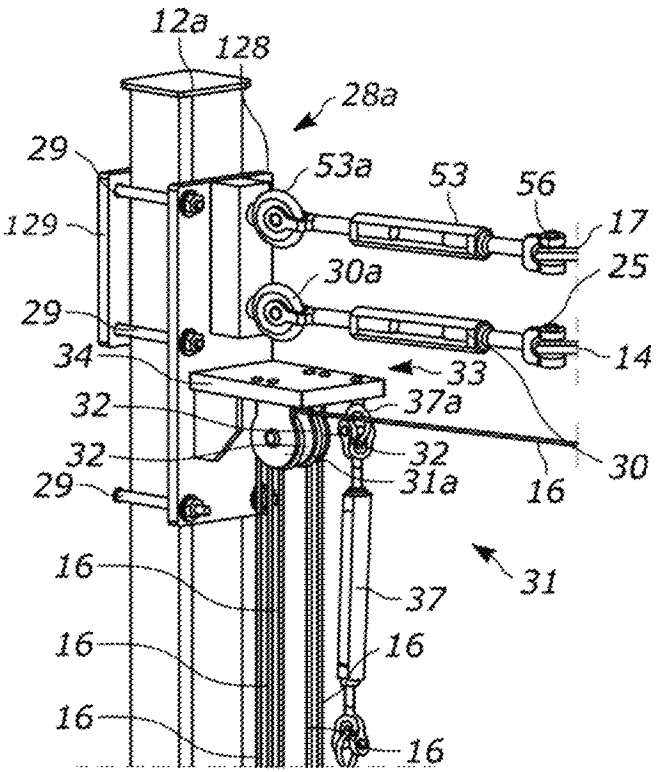
FIG. 8 is a partial perspective view of a first support member with an adjustment bracket.

In some configurations, the first end 25 of the first cable 14 and the second end 26 of the first cable 14 may each be coupled to an adjustment bracket assembly 28*a*, 28*b*, as shown in FIGS. 8 and 9. The adjustment bracket assemblies 28*a*, 28*b* may include one or more brackets 128, 129 and a plurality of connecting members 29. Each of the adjustment bracket assemblies 28*a*, 28*b* may be coupled to one of the pair of support members 12*a*, 12*b*, by the plurality of connecting members 29, (e.g., bolts or saddle clamps). The adjustment bracket assemblies 28*a*, 28*b* may be configured to allow adjustment of a height of the first cable 14. Each of the adjustment bracket assemblies 28*a*, 28*b* may be configured to be placed at different heights to allow the first cable 14 to operate at a slope. For example, the first end 25 of the first cable 14 may be attached at a higher point on support member 12*a* than second end 26 of the first cable 14 on support member 12*b*. In some configurations, the first end 25 of the first cable 14 may be coupled to the bracket 128 of the adjustment bracket assembly 28*a* and the second end 26 of the first cable 14 may be coupled to the bracket 128 of the adjustment bracket assembly 28*b* by a fastening member (not shown). In other configurations, such as in FIG. 8, the first end 25 of the first cable 14 may be coupled to the adjustment bracket assembly 28*a* by a turnbuckle assembly 30 which is configured to allow adjustment of a tension of the first cable 14. Similarly, as in FIG. 9, the second end 26 of the first cable 14 may be coupled to the adjustment bracket assembly 28*b* by a turnbuckle assembly 30 which is configured to allow adjustment of a tension of the first cable 14. The turnbuckle assembly 30 may be attached to the bracket 128 of the adjustment bracket assembly 28*a*, 28*b* by the use of a fastening member 30*a* (e.g., eye bolts).

With reference to FIGS. 3, 4, and 7-9, a pulley system 31 may be associated with the support member 12*a* and may include pulley devices 31*a*, 31*b*. At least one of the pulley devices 31*a*, 31*b* may include a plurality of sheaves 32, which are concentrically aligned. The pulley device 31*a* may be attached to a bracket assembly 33, which, in turn, is coupled to the support member 12*a* at or near an upper end thereof. The bracket assembly 33 may include a bracket 34 and at least one connecting member 35 (e.g., a saddle clamp), as in FIGS. 4 and 8. The bracket 34 may be coupled to the support member 12*a* by the at least one connecting member 35 or through another suitable method (e.g., welding). In configurations featuring an adjustment bracket assembly 28*a*, the bracket 34 may be coupled to the bracket 128 of the adjustment bracket assembly 28*a*. The pulley device 31*a* may be attached to the bracket 34.

Figure 3:
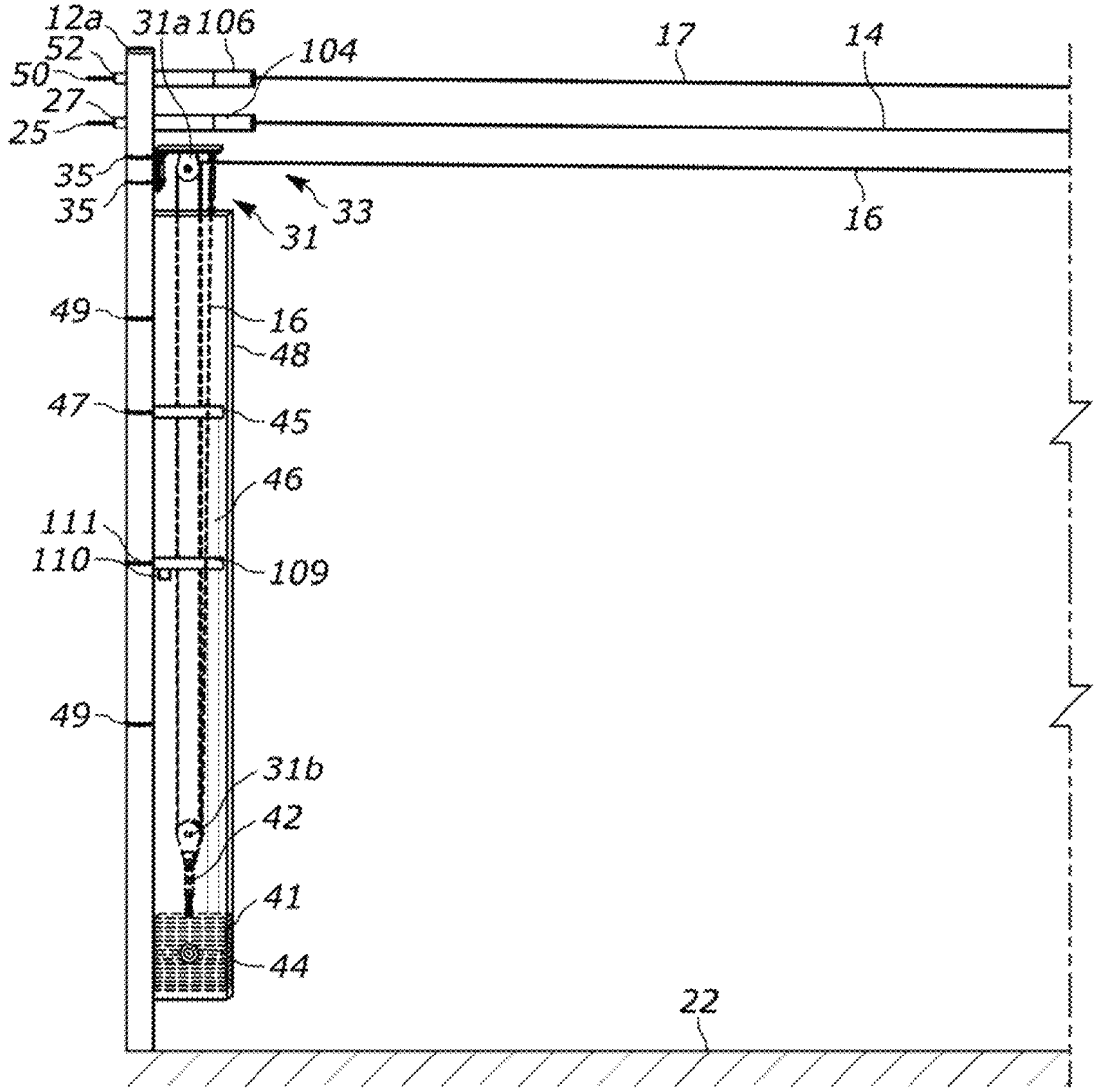
FIG. 3 is a front view of a pulley system and a first support member of the tackling apparatus shown in FIG. 1.
Figure 4:
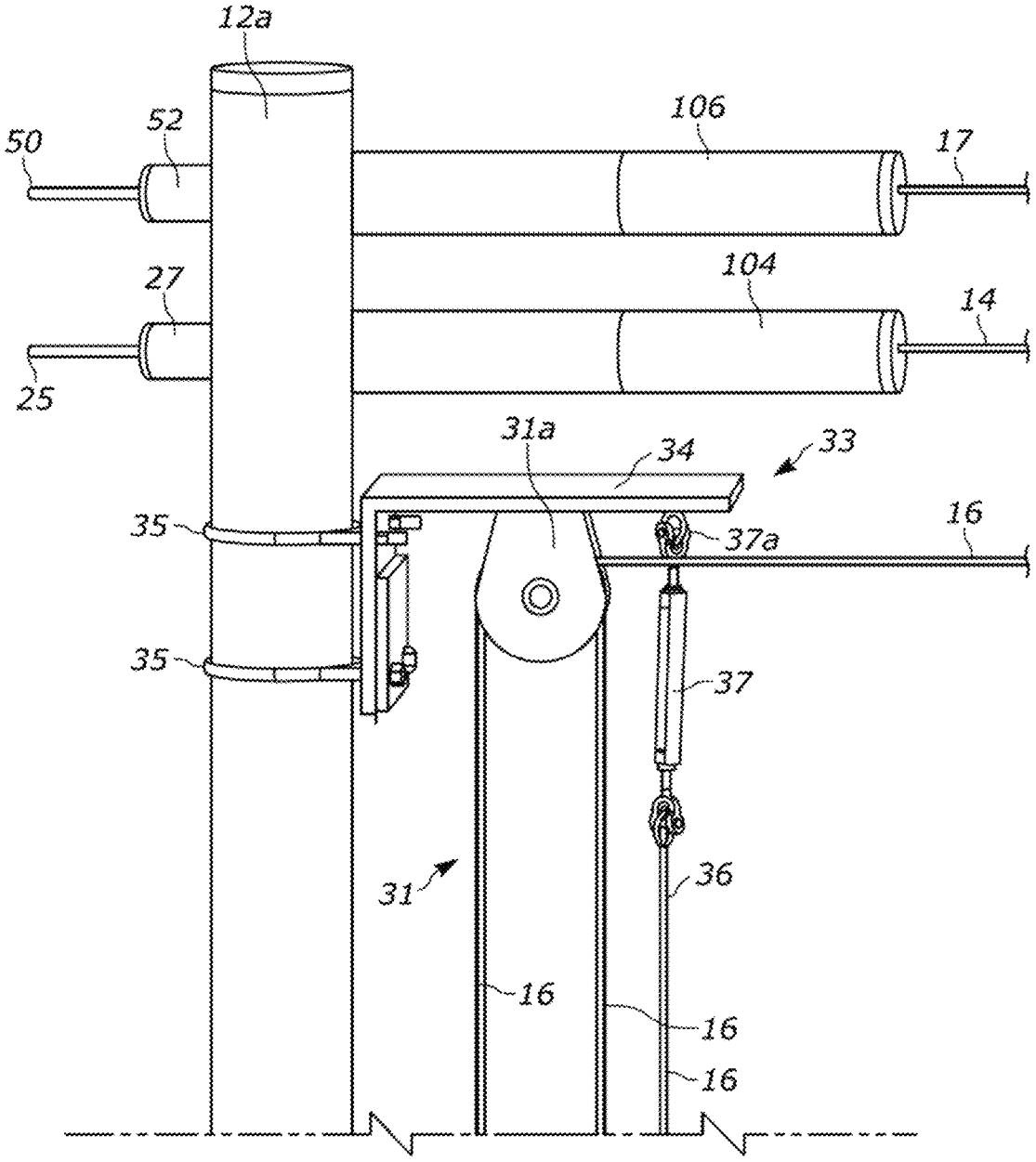
FIG. 4 is a front view of a bracket assembly of the tackling apparatus shown in FIG. 1.
Figure 5:
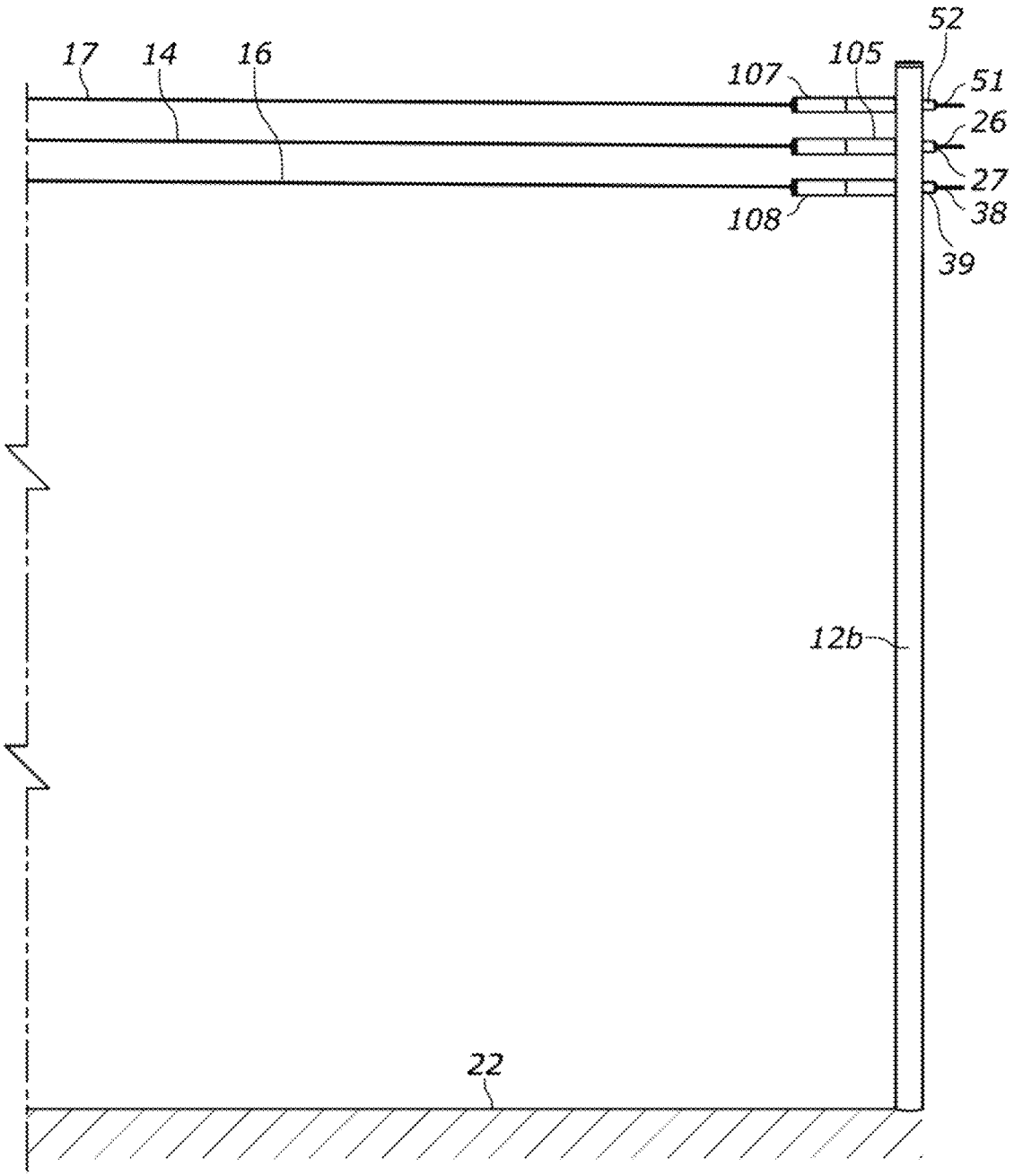
FIG. 5 is a front view of a second support member of the tackling apparatus shown in FIG. 1.
Figure 6:
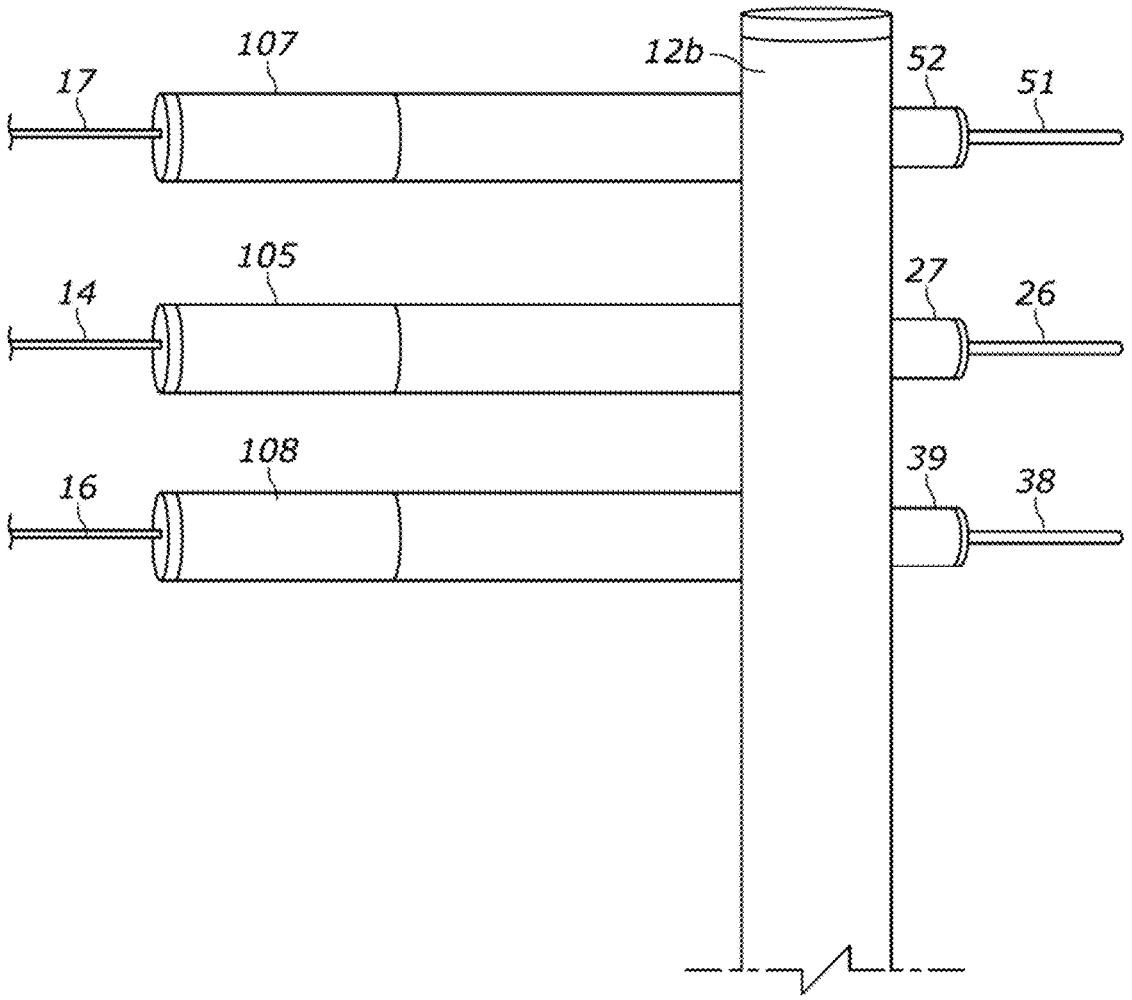
FIG. 6 is a partial front view of a second support member of the tackling apparatus shown in FIG. 1.
Figure 7:
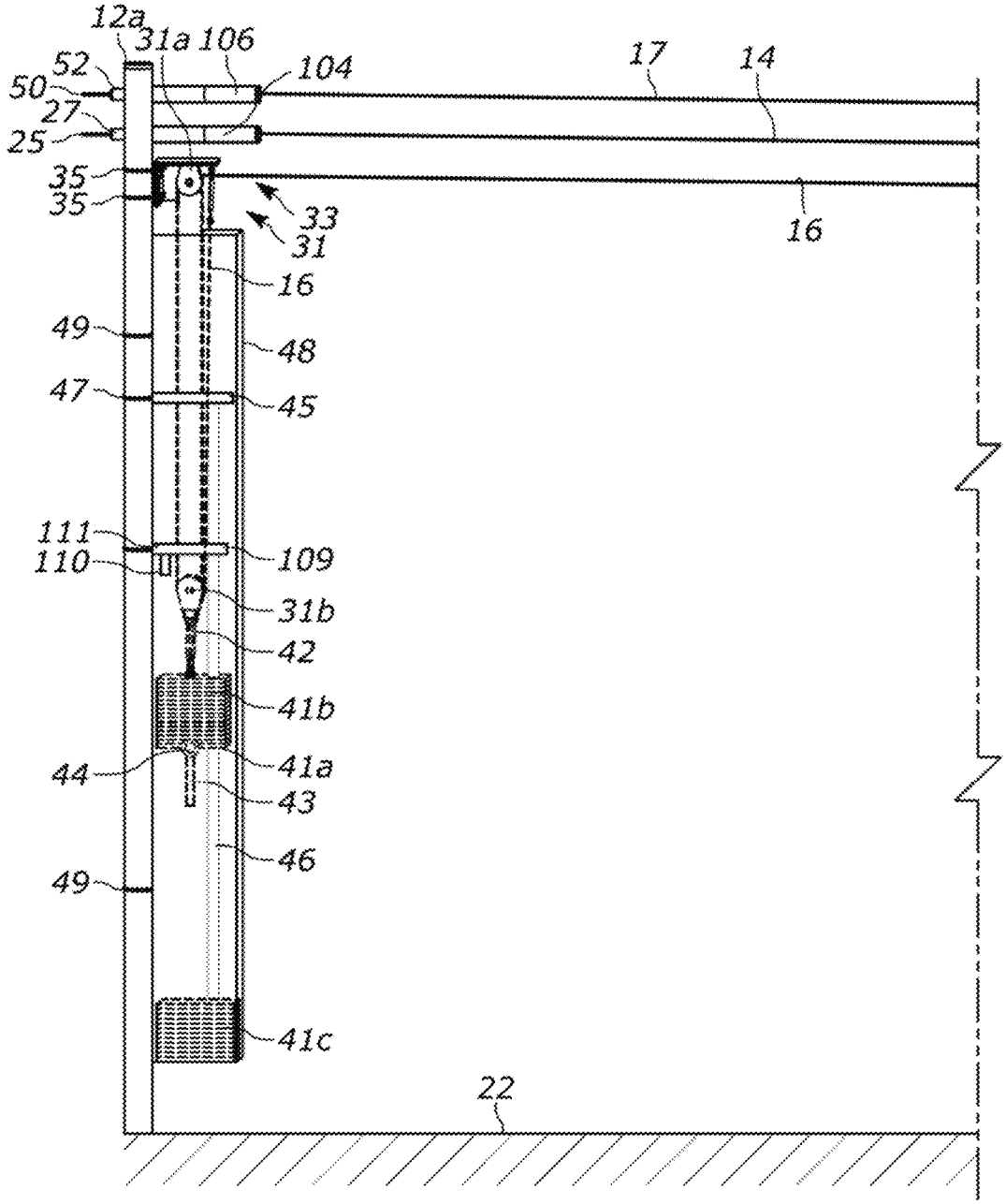
FIG. 7 is a front view of the pulley system after the tackling bag is tackled.

The second cable 16 is positioned below the first cable 14 and extends between the pair of support members 12. The second cable 16 may have a length that is longer than a length of the first cable 14. The second cable 16 may support the bag 20 and may extend around the pulley system 31 (FIGS. 3 and 7). That is, the second cable 16 may extend around the pulley devices 31*a*, 31*b*. The second cable 16 may include a first end 36 that is attached to the bracket 34, thus fixing the first end 36 of the second cable 16 to the support member 12*a* (FIG. 8). The first end 36 of the second cable 16 may attach to the bracket 34 by a turnbuckle assembly 37 configured to allow adjustment of a tension of the second cable 16. The turnbuckle assembly 37 may be attached to the bracket 34 by the use of a fastening member 37*a* (e.g., eye bolts). A second end 38 of the second cable 16 may extend through an aperture (not shown) of the support member 12*b* (FIGS. 1, 2, 5 and 6). A fastening member 39 (e.g., locking nut or eye-bolt) may be secured to the second end 38 of the second cable 16 to attach the second cable 16 to the support member 12*b*.

In some configurations, the second end 38 of the second cable 16 may be coupled to the adjustment bracket assembly 28*b* (FIG. 9). The adjustment bracket assembly 28*b* may be configured to allow adjustment of a height of the second cable 16. In some configurations, the second end 38 of the second cable 16 may be coupled to the bracket 128 of the adjustment bracket assembly 28*b* by a fastening member (not shown). In other configurations, such as in FIG. 9, the second end 38 of the second cable 16 may be coupled to the bracket 128 of the adjustment bracket assembly 28*b* by a turnbuckle assembly 40 configured to allow adjustment of a tension of the second cable 16. The turnbuckle assembly 40 may be attached to the bracket 128 of the adjustment bracket assembly 28*b* by the use of a fastening member 40*a* (e.g., eye bolts).

With reference to FIGS. 1, 3, and 7, stacked weights 41 may be attached to the pulley device 31*b* via an attachment assembly 42. An active amount of weight of the stacked weights 41 may be adjustable, such that a desired amount of weight is selected. The attachment assembly 42 may include a rod 43 and a pin 44, such that the pin 44 extends through a weight plate 41*a* of the stacked weights 41 and through the rod 43 (FIG. 7). In this fashion, any weight plate 41*b* of the stacked weights 41 above the weight plate 41*a* will be also be coupled to the pulley device 31*b*. Any weight plates 41*c* of the stacked weights 41 below the weight plate 41*a* may remain stationary and would not be coupled to the pulley device 31*b*. In this way, weight plates 41*a*, 41*b*, which are coupled to pulley device 31*b*, may provide resistance to a tackler that is tackling the body 20, thereby accurately simulating live game tackling.

A weight bracket 45 may be coupled at least one guide rod 46, which extends downward through at least one aperture (not shown) of the stacked weights 41. The at least one guide rod 46 may be configured to remain stationary and maintain alignment of the stacked weights 41. The weight bracket 45 may be coupled to the support member 12*a* by at least one connecting member 47 (e.g., a saddle clamp).

In configurations in which at least one of the pulley devices 31*a*, 31*b* includes a plurality of sheaves 32, the second cable 16 may extend around the pulley devices 31*a*, 31*b* multiple times, as shown in FIGS. 3, 4, 7, and 8. In such configurations, a distance in which the weight plates 41*a*, 41*b* travel when a user is tackling the body 20 is reduced by a factor related to the number of sheaves in the plurality of sheaves 32. For example, if the pulley devices 31*a*, 31*b* each include three sheaves in the respective plurality of sheaves 32 (i.e., a triple pulley system), then weight plates 41*a*, 41*b* will travel a third of a distance which the second cable 16 travels.

The stacked weights 41 and the portion of the second cable 16 extending adjacent to the support member 12*a* may be housed in a housing 48, as shown in FIGS. 1, 2, 3, and 7. The housing 48 may be attached to the support member 12*a* via a plurality of connecting members 49 (e.g., saddle clamps).

As shown in FIGS. 1 and 2, the third cable 17 may extend between the pair of support members 12 and may support the rolling mechanism 18. The third cable 17 may be rigid and be configured to withstand a load afflicted on the third cable 17 during a tackling event. With reference to FIGS. 1-7, a first end 50 of the third cable 17 may extend through an aperture (not shown) of the support member 12*a* (FIGS. 1-4) and a second end 51 of the third cable 17 may extend through an aperture (not shown) of the support member 12*b* (FIGS. 1, 2, 5 and 6). A fastening member 52 (e.g., locking nut or eye-bolt) may be secured to the first and second ends 50, 51 of the third cable 17 to attach the third cable 17 to the pair of support members 12.

In some configurations, the first end 50 of the third cable 17 may be coupled to the adjustment bracket assembly 28*a* and the second end 51 of the third cable 17 may be coupled to the adjustment bracket assembly 28*b*, as shown in FIGS. 8 and 9. The adjustment bracket assemblies 28*a*, 28*b* may be configured to allow adjustment of a height of the third cable 17. Each of the adjustment bracket assemblies 28*a*, 28*b* may be configured to be at different heights to allow the third cable 17 to operate at a slope. For example, the first end 50 of the third cable 17 may be attached at a higher point on support member 12*a* than the second end 51 of the third cable 17 on support member 12*b*. In some configurations, the first end 50 of the third cable 17 may be coupled to the bracket 128 of the adjustment bracket assembly 28*a* and the second end 51 of the third cable 17 may be coupled to the bracket 128 of the adjustment bracket assembly 28*b* by a fastening member (not shown). In other configurations, such as in FIGS. 8 and 9, the first end 50 of the third cable 17 may be coupled to the adjustment bracket assembly 28*a* and the second end 51 of the third cable 17 may be coupled to adjustment bracket assembly 28*b* by a turnbuckle assembly 53 configured to allow adjustment of a tension of the third cable 17. The turnbuckle assembly 53 may be attached to the bracket 128 of the adjustment bracket assembly 28*a*, 28*b* by the use of a fastening member 53*a* (e.g., eye bolts).

As shown in FIGS. 1, 2, and 10-15, the rolling mechanism 18 may be connected to the first cable 14, the second cable 16, and the third cable 17, and may be configured to traverse the first cable 14, the second cable 16, and the third cable 17.

As shown in FIGS. 10-13, the rolling mechanism 18 may include a first wheel housing 54, a second wheel housing 55, a third wheel housing 56 and a traveling pulley device 57.

Figure 10:
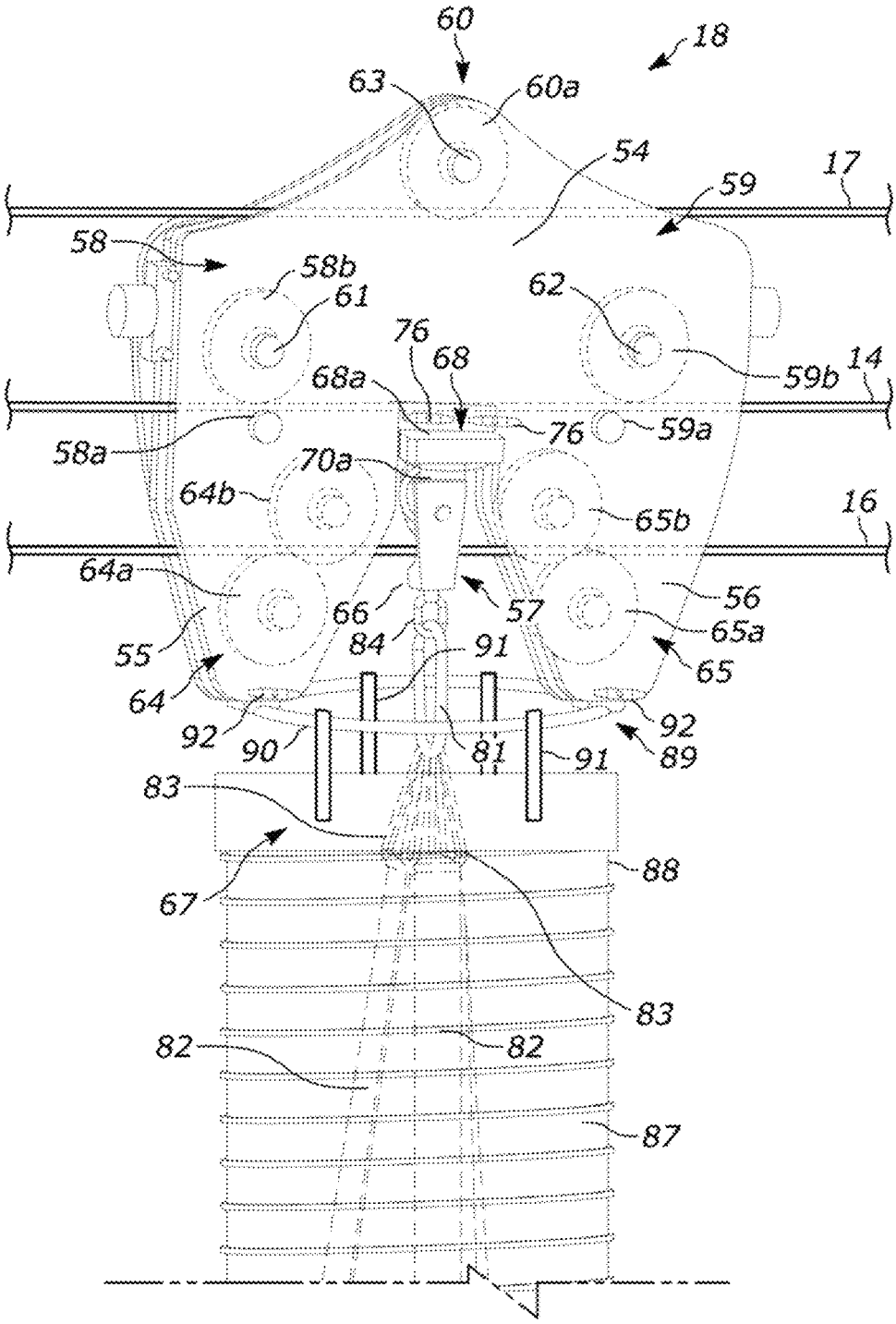
FIG. 10 is a perspective view of the trolley of the tackling apparatus shown in FIG. 1.

Turning to FIG. 10, the first wheel housing 54 may be attached to the second and third wheel housings 55, 56 and may house a first wheel assembly 58 (comprising a peg 58*a* and a wheel 58*b*), a second wheel assembly 59 (comprising a peg 59*a* and a wheel 59*b*), and a third wheel assembly 60 (comprising a wheel 60*a*). Each peg 58*a*, 59*a* may be attached to the first wheel housing 54 and each wheel 58*b*, 59*b*, 60*a* may be rotatably attached to the first wheel housing 54. The peg 58*a* may be aligned with an axle 61 of the wheel 58*b* and the peg 59*a* may be aligned with an axle 62 of the wheel 59*b*. The wheel 60*a* may also include an axle 63 therein. The first cable 14 may extend between the first wheel assembly 58 and between the second wheel assembly 59. The third cable may extend beneath the third wheel assembly 60. In this way, the first wheel housing 54 may traverse the first cable 14 from the first end 25 of the first cable 14 toward the second end 26 of the first cable 14 and the third cable 17 from the first end 50 of the third cable 17 toward the second end 51 of the third cable 17.

As shown in FIG. 10, the second wheel housing 55 may house a set of wheels 64 (comprising wheel 64*a* and wheel 64*b*). The wheels 64*a*, 64*b* may have the same diameter. Each wheel 64*a*, 64*b* may be rotatably attached to the second wheel housing 55. The set of wheels 64 may be offset from each other (i.e., axles of each wheel 64*a*, 64*b* are offset from one another). The second cable 16 may extend between the set of wheels 64. In this way, the second wheel housing 55 may traverse the second cable 16 from the first end 36 of the second cable 16 toward a second end 38 of the second cable 16.

Similarly, the third wheel housing 56 may house a set of wheels 65 (comprising wheel 65*a* and wheel 65*b*). The wheels 65*a*, 65*b* may have the same diameter. Each wheel 65*a*, 65*b* may be rotatably attached to the third wheel housing 56. The set of wheels 65 may be offset from each other (i.e., axles of each wheel 65*a*, 65*b* are offset from one another). The second cable 16 may extend between the set of wheels 65. In this way, the third wheel housing 56 may traverse the second cable 16 from the first end 36 of the second cable 16 toward the second end 38 of the second cable 16.

Figure 12:
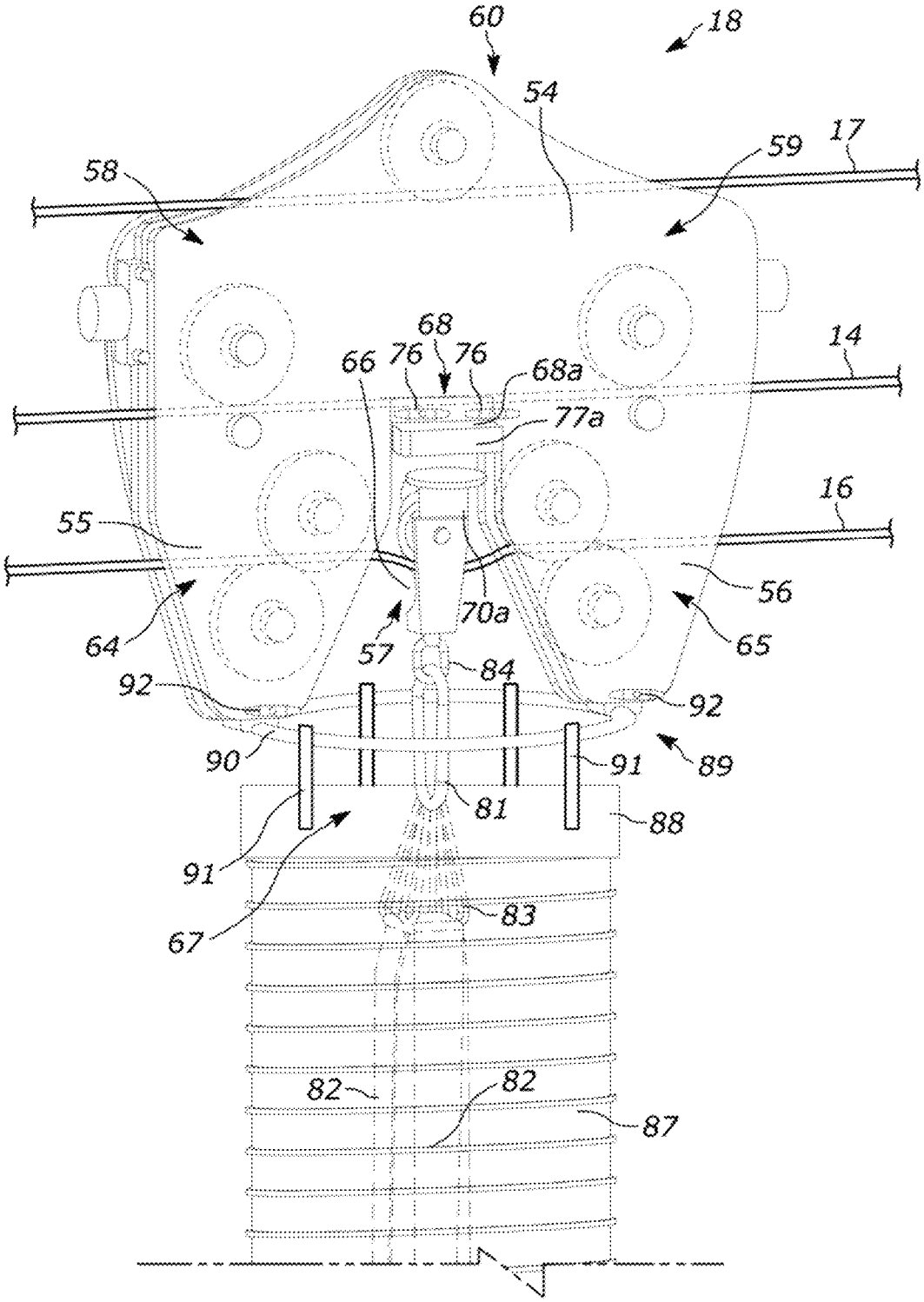
FIG. 12 is a perspective view of the trolley of FIG. 10 while the tackling bag is tackled.

As shown in FIGS. 10 and 12, the first, second and third wheel housings 54, 55, 56 may define an opening 66 that the traveling pulley device 57 may be disposed in. The traveling pulley device 57 may be attached to the tackling bag 20 (via an attachment assembly 67) and may be movable in a vertical direction relative to the first, second and third wheel housings 54, 55, 56. The traveling pulley device 57 may be positioned between the second and third wheel housings 55, 56 and may be removably attached to the first wheel housing 54 via a coupling assembly 68.

Figure 14:
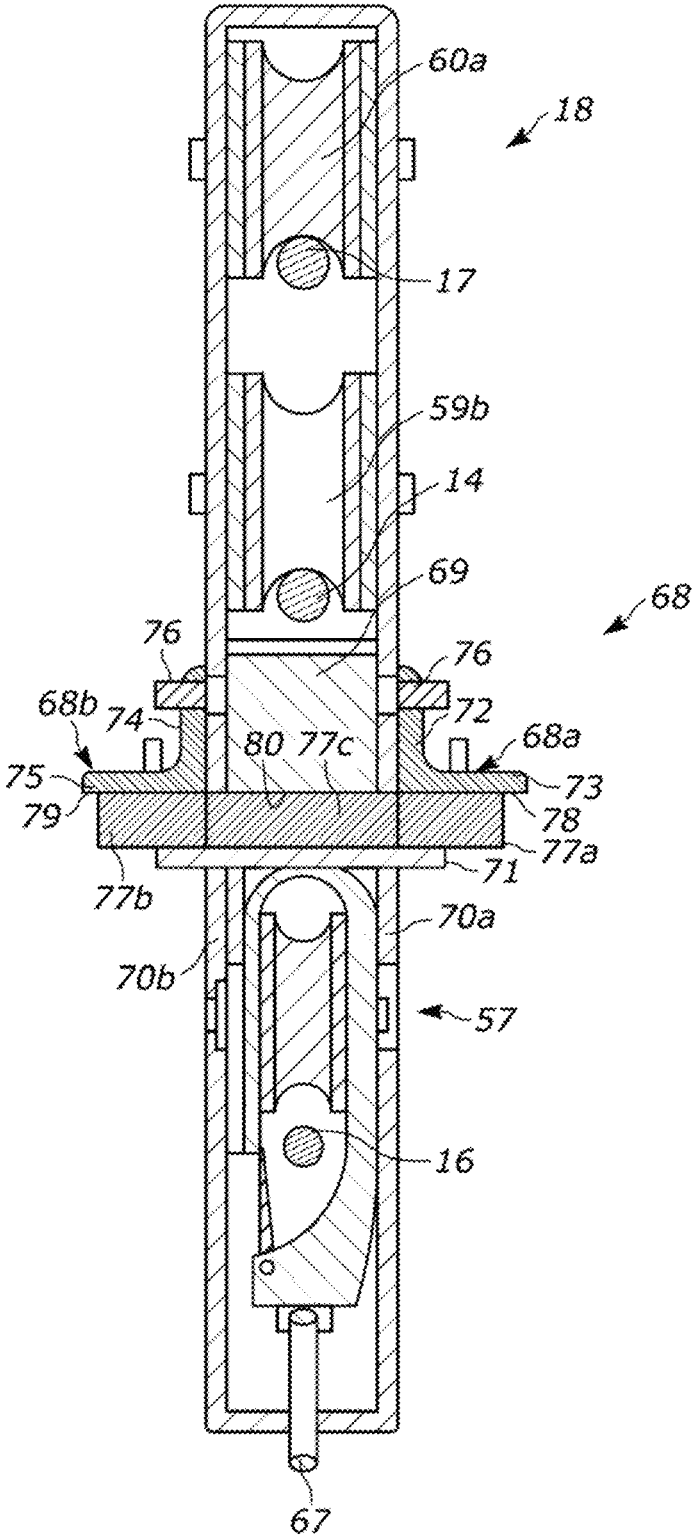
FIG. 14 is a cross-sectional view of the trolley of FIG. 10.

As shown in FIGS. 10, 12, and 14, the coupling assembly 68 may include angle brackets 68*a*, 68*b*, a housing member 69, pulley plates 70*a*, 70*b* and a coupling plate 71. The angle brackets 68*a*, 68*b* are made of a metallic material and have an L-shape. The bracket 68*a* may be attached to a first side of the first wheel housing 54 (i.e., the bracket 68*a* is located externally to the first wheel housing 54) by the use of pins, fasteners, or another method of connection. The bracket 68*a* includes a first member 72 and a second member 73 that extends perpendicular to the first member 72 (i.e., the second member 73 has a plane that extends perpendicular to a plane of the first member 72 and the first wheel housing 54). The first member 72 is attached (e.g., welded) to the first side of the first wheel housing 54.

The bracket 68*b* may be attached to a second side of the first wheel housing 54 that is opposite the first side (i.e., the bracket 68*b* is located externally to the first wheel housing 54) and includes a first member 74 and a second member 75 that extends perpendicular to the first member 74 (i.e., the second member 75 has a plane that extends perpendicular to a plane of the first member 74 and the first wheel housing 54). The first member 74 is attached (e.g., welded) to the second side of the first wheel housing 54.

The housing member 69 is housed within the first wheel housing 54 and is attached to the coupling assembly 68 via fasteners 76. The fasteners 76 can be any suitable device such as bolts or pins. The pulley plate 70*a* is attached (e.g., welded) to a first side of the traveling pulley device 57 and the pulley plate 70*b* is attached (e.g., welded) to a second side of the traveling pulley device 57 that is opposite the first side. The coupling plate 71 is made of a metallic material and is attached (e.g., welded) to the plates 70*a*, 70*b*. The coupling plate 71 extends parallel to the second member 73 of the bracket 68*a* and the second member 75 of the bracket 68*b*.

A plurality of magnets 77 (comprising magnets 77*a*, 77*b*, and 77*c*) may be coupled to the brackets 68*a*, 68*b* and the housing member 69. That is, magnet 77*a* may be attached to a planar surface 78 of the second member 73 (via fasteners), magnet 77*b* may be attached to a planar surface 79 of the second member 75 (via fasteners) and magnet 77*c* may be attached to a planar surface 80 of the housing member 69 (via fasteners). The magnets 77 may be neodymium magnets, for example. The magnets 77 may be attracted to the metallic material of the coupling plate 71 and may produce a magnetic force urging the traveling pulley device 57 against the magnets 77 and away from the second cable 16. In this way, the traveling pulley device 57 does not ride along the second cable 16 (i.e., the traveling pulley device 57 and the second cable 16 are separated from each other) when the bag 20 is propelled from one of the support members 12*a*, 12*b* towards the other of the support members 12*a*, 12*b*, which, in turn, increases the bag 20 speed from the one of the support members 12*a*, 12*b* towards the other of the support members 12*a*, 12*b*.

Figure 11:
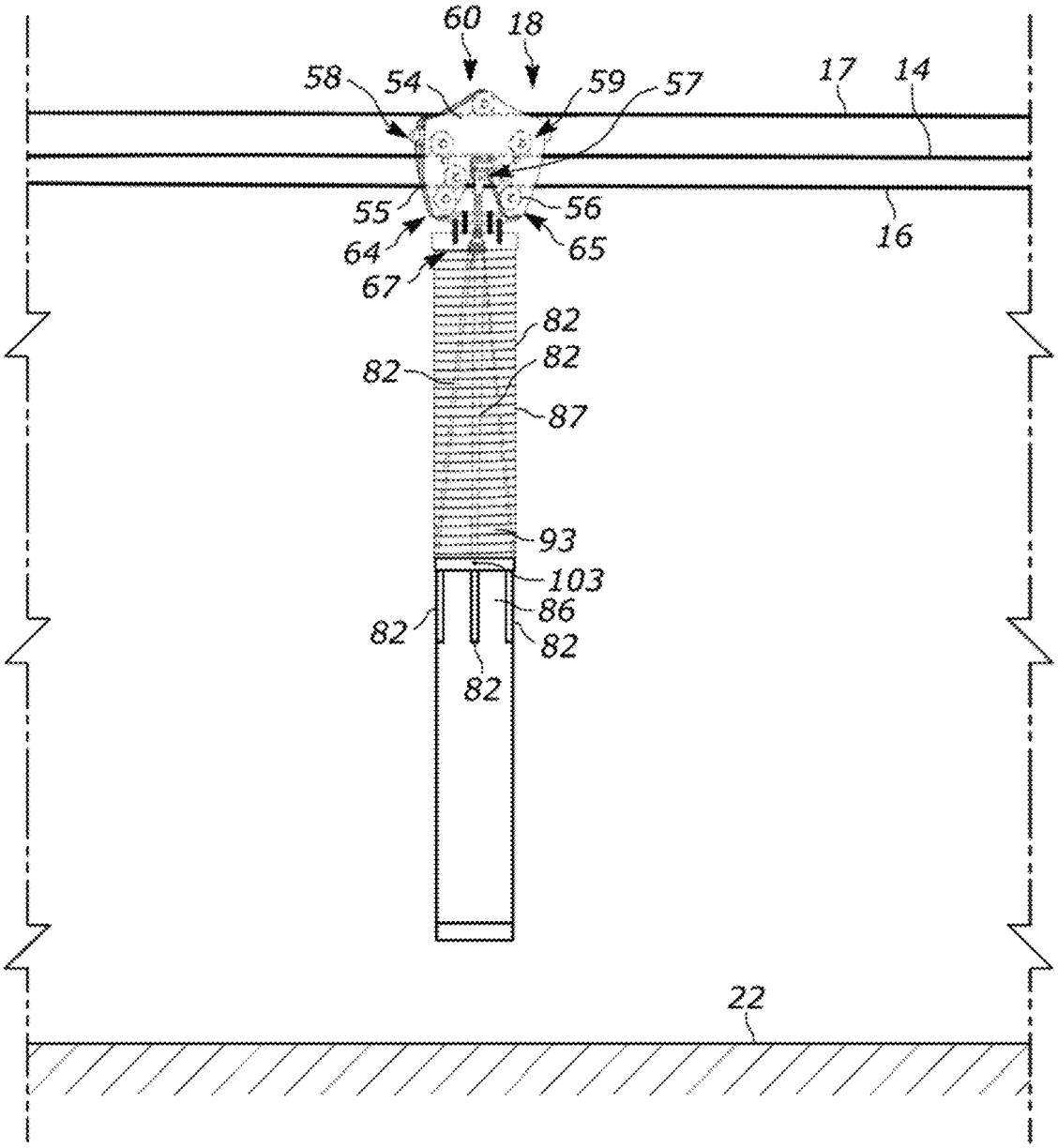
FIG. 11 is a perspective view of a trolley, an attachment assembly and the tackling bag of the tackling of FIG. 1.

With reference to FIGS. 10 and 12, the attachment assembly 67 may include a first connecting loop 81, (e.g., a carabiner) and a plurality of straps 82. The plurality of straps 82 may be attached to the first connecting loop 81 (via a plurality of hooks 83), which, in turn, is attached to a ring 84 of the traveling pulley device 57. The plurality of straps 82 may be disposed around and attached to an upper end 86 of the tackling bag 20, as shown in FIG. 11. In this way, the traveling pulley device 57 may be attached to the tackling bag 20. The plurality of straps 82 may be made of an unstretchable material.

As shown in FIGS. 10-13 and 15, a sleeve or shroud 87 may house the plurality of straps 82 and at least partially house the first connecting loop 81. The sleeve 87 may be made of a stretchable material, for example. For example, the sleeve 87 may be 4 feet in length in its original state (i.e., unstretched) and may be allowed to stretch up to 12.5 feet in length. A first end 88 of the sleeve 87 may be attached to the rolling mechanism 18 via a bracket assembly 89. The bracket assembly 89 may include a ring 90, a plurality of hooks 91, and fasteners 92. The plurality of hooks 91 connect the sleeve 87 to the ring 90. The fasteners 92 couple the ring 90 to the rolling mechanism 18. The fasteners 92 may be of any suitable fastening device, such as pins, clips, or clamps. A second end 93 of the sleeve 87 may be attached to the upper end 86 of the tackling bag 20 via attachments 103 (e.g., snap attachments), as shown in FIG. 11.

As shown in FIGS. 1, 2, and 11, the tackling bag 20 may be suspended above the surface 22 a predetermined distance (e.g., a foot) and may be supported by the second cable 16, the third cable 17, and the travelling pulley device 57. The tackling bag 20 may be cylindrical-shaped and may be made of a polyester and/or neoprene material, for example. The tackling bag 20 may be 6 feet in height, for example, and may weigh between 20 lbs and 50 lbs. In some configurations, the tackling bag 20 may include apertures (not shown), which allows air to be released when the bag 20 is tackled, thereby softening the impact experienced by the tackler.

Bumpers 104 may be disposed on the first cable 14 at the first end 25 and may extend past the first housing 48 such that the rolling mechanism 18 and the tackling bag 20 do not contact the first housing 48 and/or the pulley system 31. Likewise, bumpers 105 may be disposed on the first cable 14 at the second end 26 such that the rolling mechanism 18 and the tackling bag 20 do not contact the support member 12*b* adjacent to the second end 26 of the first cable 14. Similarly, bumpers 106 may be disposed on the third cable 17 at the first end 50, bumpers 107 may be disposed at the second end 51 of the third cable 17, and bumpers 108 may be disposed at the second end 38 of the second cable 16 to perform a similar function as bumpers 105 and bumpers 107. Any of bumpers 104, 105, 106, 107, 108 may be present in configurations which include turnbuckle assemblies 30, 40, 53 (i.e., when adjustment bracket assemblies 28*a*, 28*b* are included) to prevent the rolling mechanism 18 from contacting the turnbuckles assemblies 30, 40, 53.

With continued reference to FIGS. 1-17, operation of the apparatus 10 will be described in detail. As shown in FIGS. 1 and 2, the tackling bag 20 may start out adjacent to the first support member 12*a* (or adjacent to the support member 12*b*). A user may propel the tackling bag 20 from a starting position near the support member 12*a* toward the support member 12*b* (or from the support member 12*b* toward the support member 12*a* if the tackling bag 20 starts out adjacent to the support member 12*b*). In this way, the rolling mechanism 18 may traverse the first cable 14, the second cable 16, and the third cable 17 (i.e., the first wheel housing 54 may traverse the first cable 14 from the first end 25 of the first cable 14 toward the second end 26 of the first cable 14 and the third cable 17 from the first end 50 of the third cable 17 toward the second end 51 of the third cable 17, and the wheel housings 55, 56 and the traveling pulley device 57 may traverse the second cable 16 from the first end 36 of the second cable 16 toward the second end 38 of the second cable 16). While the tackling bag 20 is moving toward the support member 12*b*, a tackler (not shown) may tackle the moving tackling bag 20 to the ground, such as in FIG. 15.

Figure 13:
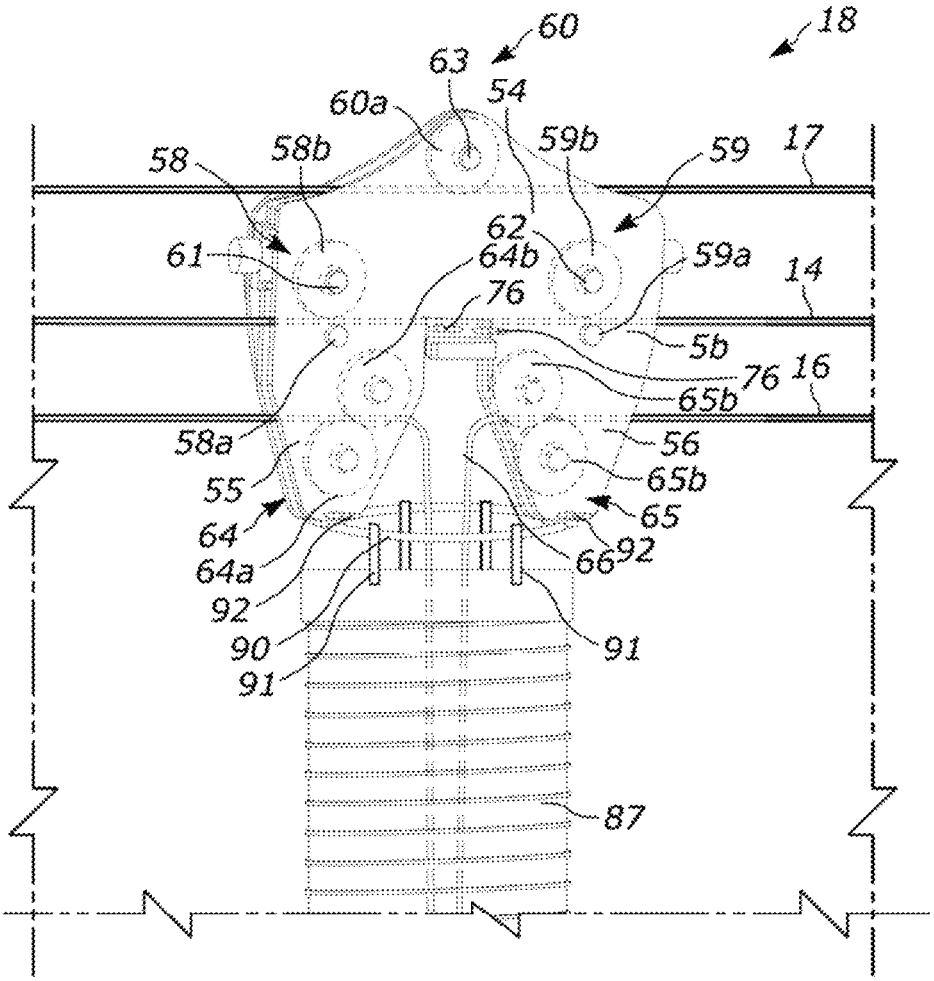
FIG. 13 is a perspective view of the trolley of FIG. 10 after the tackling bag is tackled.
Figure 15:
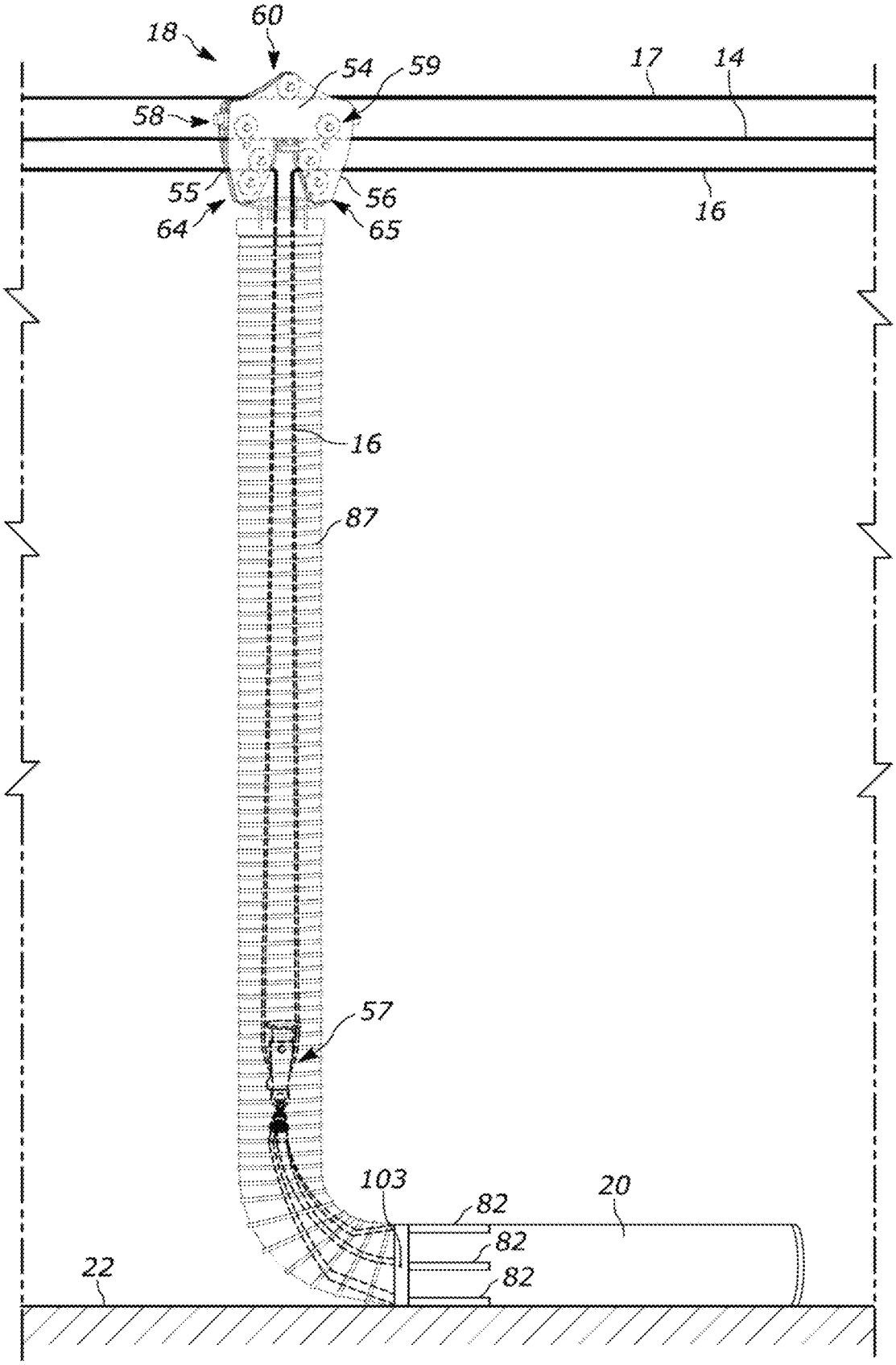
FIG. 15 is front view of the trolley, the attachment assembly and the tackling bag after the tackling bag is tackled.

As shown in FIG. 12, upon tackling the bag 20, the traveling pulley device 57 and the coupling plate 71 may be detached from the magnets 77 and move downwardly in the vertical direction relative to the first, second and third wheel housings 54, 55, 56. In turn, as shown in FIGS. 13 and 15, a portion of the second cable 16 extends around the wheels 64*b*, 65*b* and moves downwardly in the vertical direction. It should be understood that once the portion of the second cable 16 extends around the wheels 64*b*, 65*b* and moves downwardly in the vertical direction, the rolling mechanism 18 is prevented from continuing to traverse the first, second, and third cables 14, 16, 17. As shown in FIG. 7, weight plates 41*a*, 41*b* may move upwardly in the vertical direction (via the pulley system 31) when the portion of the second cable 16 is moving downwardly in the vertical direction, thereby providing resistance to the tackler that is tackling the bag 20.

As shown in FIGS. 3 and 7, a bumper bracket 109 may include a bumper 110 to provide a stopping point for the pulley device 31*b* and weight plates 41*a*, 41*b* moving upwardly in the vertical direction when the tackling bag 20 is tackled. The bumper 110 may be configured to contact the stacked weights 41 when the stacked weights 41 reach a vertical travel limit. The bumper bracket 109 may be include a space for the at least one guide rod 46 and the pulley device 31*b* to pass through the bumper bracket 109 without making contact with said bracket 109. The bumper bracket 109 may be coupled to the support member 12*a* by at least one connecting member 111 (e.g., a saddle clamp). In some configurations, the bumper 110 may be attached to the weight bracket 45, but will operate identically to the description above.

Once the tackler disengages from the tackling bag 20, the tackling bag 20 returns to its original position (i.e., the coupling plate 71 is attached to the magnets 77 and the tackling bag 20 is suspended above the surface 22 at a predetermined distance). That is, once the tackler disengages from the tackling bag 20, weight plates 41*a*, 41*b* move downwardly to their original position, which, in turn, causes the second cable 16 to lift the tackling bag 20 off the surface 22. As the tackling bag 20 is raised by the weight plates 41*a*, 41*b*, magnetic connection between the coupling plate 71 and the magnets 77 will couple the coupling plate 71 and the magnets so that the tackling bag 20 is suspended above the surface 22 at the predetermined distance. The user may move the tackling bag 20 back adjacent to the support member 12*a* and repeat the process over again. It should be understood that the cable shroud 87 may stretch to cover the portion of the second cable 16 that extends around the wheels 64*b*, 65*b* and moves downwardly in the vertical direction when the bag 20 is tackled.

Figure 16:
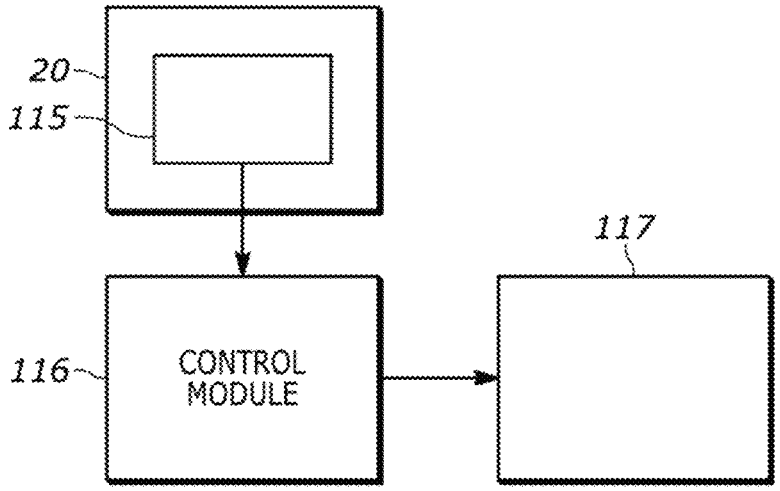
FIG. 16 is a block diagram illustrating communication between a control module, sensors and a notification system.

As shown in FIG. 16, a plurality of sensors 115 may be associated with the tackling bag 20 (e.g., the sensors 115 may be disposed at the upper end 86 and/or a middle portion of the tackling bag 20) and may be adapted to measure a parameter that is indicative of the force applied to the tackling bag 20 when a tackler strikes or tackles the bag 20. For example, the parameter may be a force or pressure applied to the tackling bag 20 when the tackler tackles the bag 20. In another example, the parameter may be an acceleration of the bag 20 when it is tackled, which is used along with the mass of the bag 20 to calculate the force ($F=m\times a$) applied to the tackling bag 20 by the tackler. It should be understood that the plurality of sensors 115 may be disposed at various other locations of the tackling bag 20 (e.g., a lower end of the tackling bag 20).

As shown in FIG. 16, a control module 116 may be in wired or wireless communication with the sensors 115 and may receive data from the sensors 115. The data may include the parameter that is indicative of the force applied to the tackling bag 20. When the control module 116 receives data from the sensors 115, the control module 116 may communicate the data to a notification system 117. The notification system 117 could be a computer, a mobile phone (e.g., smartphone), or a tablet, for example, or any other communication device or network of devices. The control module 116 may be in communication with the notification system 117 via, for example, an internet, Wi-Fi, Bluetooth®, Zigbee®, power-line carrier communication (PLCC), or cellular connection or any other wired or wireless communication protocol.

Figure 17:
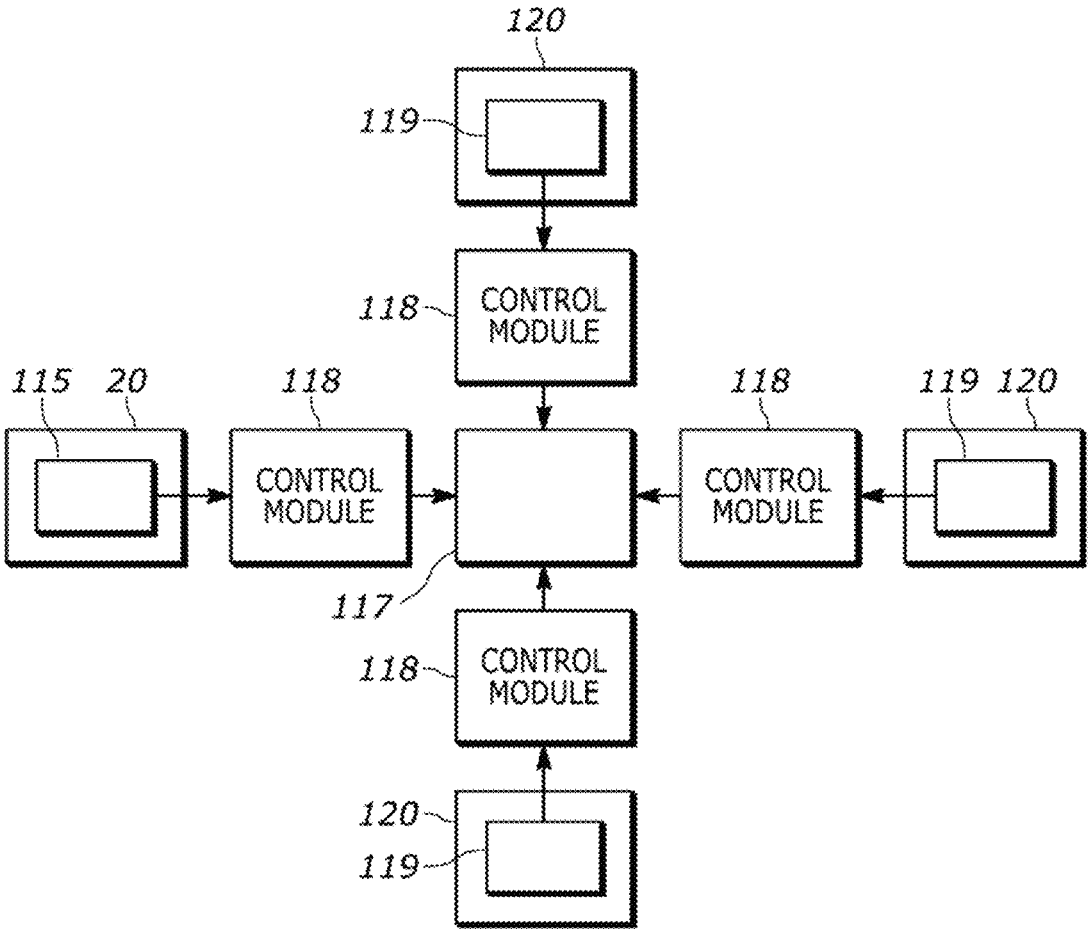
FIG. 17 is a block diagram illustrating communication between control modules, sensors and a notification system.

With reference to FIGS. 16 and 17, the notification system 117 may include data from the control module 116 that is in communication with the sensors 115 associated with the tackling bag 20 and may also include data from other control modules 118 that are in communication with respective sensors 119 associated with respective tackling bags 120. The control modules 118 may be in communication with the notification system 117 via, for example, an internet, Wi-Fi, Bluetooth®, Zigbee®, power-line carrier communication (PLCC), or cellular connection or any other wired or wireless communication protocol. The control modules 118 may also be in wired or wireless communication with the respective sensors 119 and may receive data from the respective sensors 119. The data the control modules 118 receive from the respective sensors 119 may include parameters that are indicative of the force applied to the respective tackling bags 120. In this way, the notification system 117 may include data gathered for various tackling bags 20, 120 for users to view and may alert users when a record force is recorded and communicated to the notification system 117.

Figure 18:
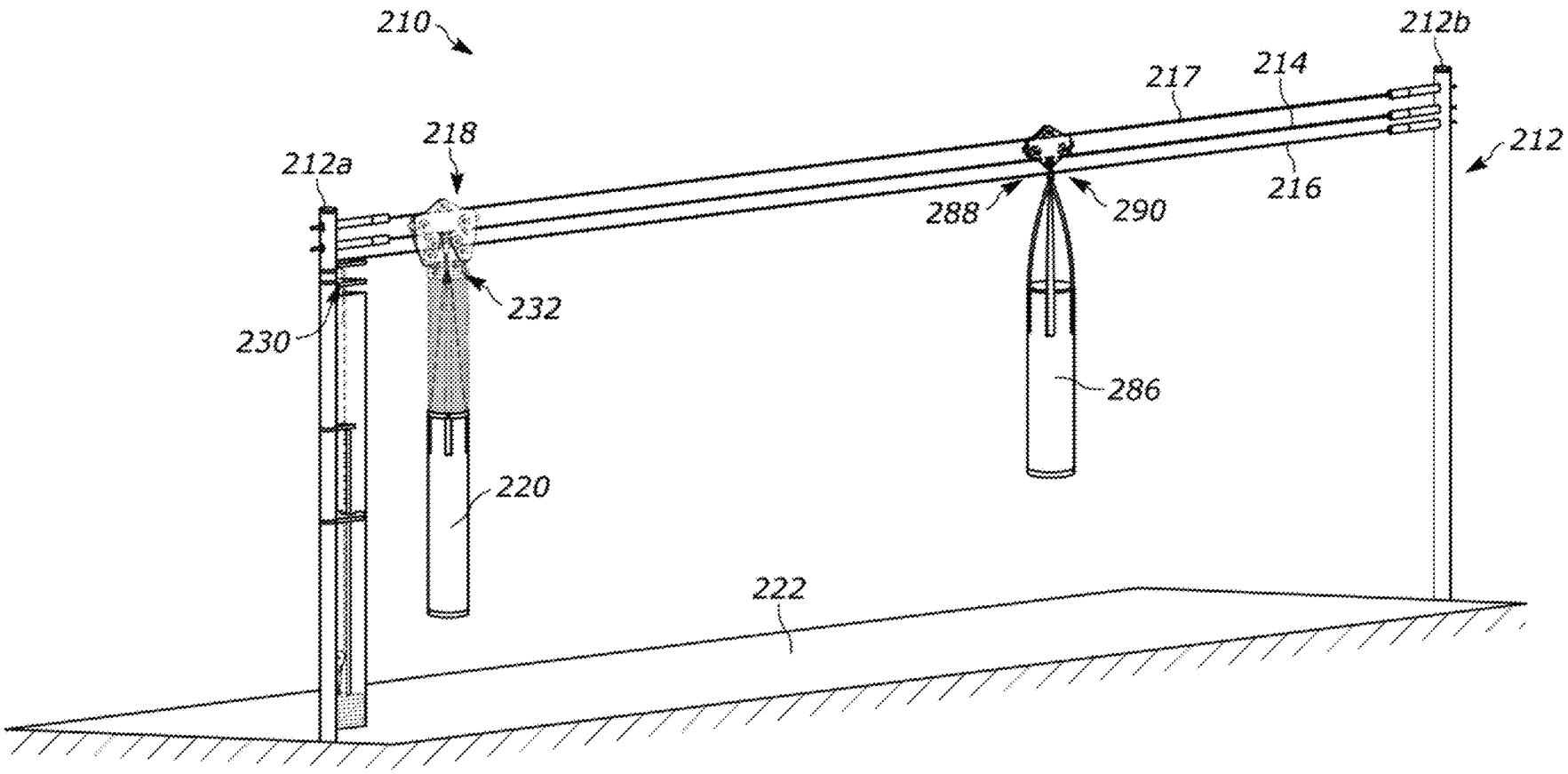
FIG. 18 is a perspective view of another tackling apparatus according to the principles of the present disclosure.
Figure 19:
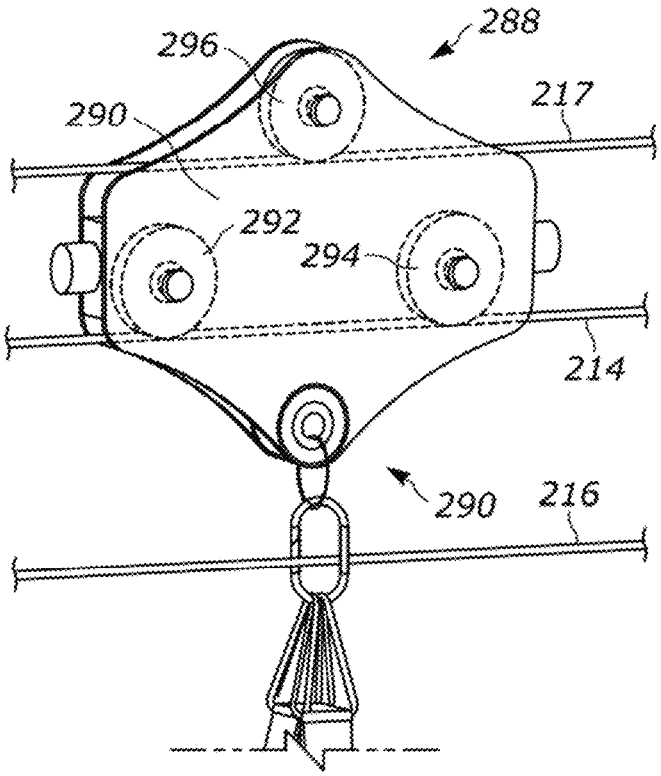
FIG. 19 is a perspective view of a trolley of FIG. 18 carrying a utility bag.
Figure 20:
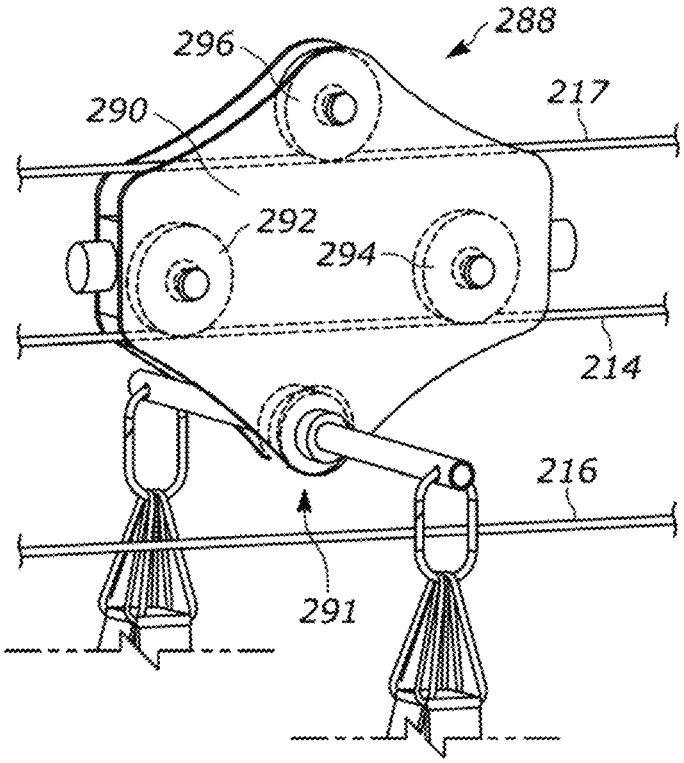
FIG. 20 is a perspective view of a trolley of FIG. 18 carrying a plurality of utility bags; and Corresponding reference numerals indicate corresponding parts throughout the several views of the drawings.

With reference to FIGS. 18-20, another apparatus 210 is provided. The structure and function of the apparatus 210 may be similar or identical to apparatus 10 described above, apart from any exceptions noted below.

The apparatus 210 may include a pair of elongated support structures or members 212 (comprised of support member 212*a* and support member 212*b*), first, second, and third cables 214, 216, 217 a trolley or rolling mechanism 218 and an elongated tackling bag or body 220. The structure and function of the pair of elongated support structures 212, the first, second, and third cables 214, 216, 217, the rolling mechanism 218, and the tackling bag 220 may be similar or identical to that of the pair of elongated support structures 12, the first, second, and third cables 14, 16, 17, the rolling mechanism 18, and the tackling bag 20, respectively, described above, and therefore, will not be described again in detail.

The apparatus 210 may further include a pulley system 230 and an attachment assembly 232. The structure and function of the pulley system 230 and the attachment assembly 232 may be similar or identical to that of the pulley system 31 and the attachment assembly 67, respectively, described above, and therefore, will not be described again in detail.

In some configurations, the apparatus 210 may include at least one utility bag 286 that may be suspended above the surface 222 a predetermined distance (e.g., a foot) and may be supported by the first cable 214 and the third cable 217 (via a trolley 288 and connecting assembly 290), as shown in FIG. 18. The utility bag 286 may be propelled from a starting position near one of the support members 212*a*, 212*b* towards the other of the support members 212*a*, 212*b* independently of the tacking bag 220. The utility bag 286 may be located further in the direction in which the utility bag 286 and the tackling bag 220 are configured to propel. For example, if the utility bag 286 and the tackling bag 220 are configured to be propelled from near support member 212*a* to near support member 212*b*, the utility bag 286 may be closer to 212*b* than the tackling bag 220. The utility bag 286 may be cylindrical-shaped and may be made of a polyester and/or neoprene material, for example. Each utility bag 286 may be 6 feet in height, for example, and may be between 50 lbs and 90 lbs. The trolley 288 may be connected to the first cable 214 and may be configured to traverse the first cable 214 and the third cable 217. The connecting assembly 290 may be coupled to the trolley 288 and the utility bag 286 (FIG. 19). In some configurations, a connecting assembly 291 may be configured to allow a utility bag 286*a* to be adjacent to another utility bag 286*b* (FIG. 20).

The trolley 288 may include a wheel housing 290, including a first wheel 292, a second wheel 294, and a third wheel 296 which are rotatably attached to the trolley 288 (FIGS. 19 and 20). The first cable 214 may extend beneath the first wheel 292 and the second wheel 294. Similarly, the third cable may extend beneath the third wheel 296. In this way, the trolley 288 may traverse the first cable 214 from a first end 255 of the first cable 214 toward a second end 256 of the first cable 214 and the third cable 217 from a first end 257 of the third cable 217 toward a second end 258 of the third cable 217.

The at least one utility bag 286 provides more functionality to the apparatus 210, thereby allowing tacklers to more accurately simulate game time situations. For example, in one drill, one user may propel the at least one utility bag 286 from one of the support members 212*a*, 212*b* towards the other of the support members 212*a*, 212*b* while another user simultaneously propels the tacking bag 220 from the one of the support members 212*a*, 212*b* towards the other of the support members 212*a*, 212*b*. In such a drill, the tackler must shed (i.e., escape) the at least one utility bag 286 and then tackle the tackling bag 220.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

In this application, including the definitions below, the term 'module' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "for."

What is claimed is:

1. An apparatus comprising:

a pair of support members fixedly coupled to a surface;

a cable extending between the pair of support members;

a rolling mechanism configured to traverse the cable from a first end of the cable toward a second end of the cable;

a tackling bag configured to be propelled from a first support member of the pair of support members toward a second support member of the pair of support members, the tackling bag also configured to be tackled when propelled from the first support member of the pair of support members toward the second support member of the pair of support members;

a pulley system associated with the first support member of the pair of support members, comprising a first pulley device and a second pulley device, wherein at least one of the first and second pulley devices comprises a plurality of sheaves and the first cable extends around the first and second pulley devices and through each sheave of the plurality of sheaves; and a stack of weights attached to the pulley system, wherein at least a portion of the rolling mechanism is permitted to move downwardly relative to the cable when a force is applied to the tackling bag, and wherein the stack of weights is configured to provide resistance to a force applied on the tackling bag and move in a vertical direction when the force is applied on the tackling bag.

2. The apparatus of claim 1, wherein the first pulley device is coupled to the first support member of the pair of support members and the second pulley device is coupled to the stack of weights.

3. The apparatus of claim 1, wherein the cable includes a first end fixed to the first support member of the pair of support members and a second end opposing the first end fixed to the second support member of the pair of support members.

4. The apparatus of claim 3, wherein the first end of the cable includes a turnbuckle configured to adjust an amount of tension of the cable.

5. The apparatus of claim 1, further comprising a second cable including a first end coupled to the first support member of the pair of support members and a second end coupled to the second of the pair of support members, wherein the rolling mechanism comprises:

a first wheel housing including a first set of wheels rotatably coupled thereto wherein the second cable extends between two wheels of the first set of wheels, a second wheel housing including a second set of wheels rotatably coupled thereto wherein the second cable extends between two wheels of the second set of wheels; and a traveling pulley device removably coupled to at least one of the first wheel housing and the second wheel housing, wherein the rolling mechanism is configured to traverse second cable from the first end of the second cable to the second end of the second cable.

6. The apparatus of claim 5, wherein a portion of the first cable moves downwardly in a vertical direction relative to the second cable when the force is applied to the tackling bag.

7. The apparatus of claim 6, wherein the traveling pulley device is separated from the rolling mechanism when the force is applied to the tackling bag.

8. The apparatus of claim 5, wherein the rolling mechanism further comprises:

a third wheel housing including a first wheel assembly and a second wheel assembly, wherein a wheel of the first wheel assembly is rotatably coupled to the third wheel housing and a wheel of the second wheel assembly is rotatably coupled to the third wheel housing, and wherein the second cable extends through the first wheel assembly and the second wheel assembly.

9. The apparatus of claim 8, wherein a portion of the first cable moves downwardly in a vertical direction relative to the second cable when the force is applied to the tackling bag.

10. The apparatus of claim 9, wherein the traveling pulley device is separated from the rolling mechanism when the force is applied to the tackling bag.

11. An apparatus comprising:

a pair of support members fixedly coupled to a surface;

a first cable attached to and extending between the pair of support members;

a second cable extending between the pair of support members;

a third cable attached to and extending between the pair of support members;

a rolling mechanism having a first wheel housing, wherein the first wheel housing includes a first wheel assembly including a first wheel rotatably coupled thereto; and a tackling bag attached to the rolling mechanism and configured to be propelled from a first support member of the pair of support members toward a second support member of the pair of support members, the tackling bag also configured to be tackled when propelled from the first support member of the pair of support members toward the second support member of the pair of support members, wherein the rolling mechanism is configured to traverse the first, second, and third cables from a first end of the first, second, and third cables toward a second end of the first, second cable, and third cables, wherein at least a portion of the rolling mechanism is permitted to move downwardly relative to the first cable when a force is applied to the tackling bag, and wherein the first wheel is configured to remain atop the third cable when the force is applied to the tackling bag.

12. The apparatus of claim 11, wherein the rolling mechanism further comprises:

a second wheel housing including a first set of wheels rotatably coupled thereto wherein the second cable extends between two wheels of the first set of wheels, a third wheel housing including a second set of wheels rotatably coupled thereto wherein the second cable extends between two wheels of the second set of wheels; and wherein the first wheel housing is attached to at least one of the second and third wheel housings and is configured to traverse the first cable and the third cable, wherein the traveling pulley device is removably coupled to at least one of the first wheel housing and the second wheel housing, and wherein the second and third wheel housings and the traveling pulley device are configured to traverse the second cable.

13. The apparatus of claim 12, wherein the first wheel housing further includes a second wheel assembly and a third wheel assembly, wherein a wheel of the second wheel assembly is rotatably coupled to the first wheel housing and a wheel of the third wheel assembly is rotatably coupled to the first wheel housing; and wherein the second cable extends through the second wheel assembly and the third wheel assembly.

14. The apparatus of claim 12, wherein the traveling pulley device is configured to move downwardly relative to the first cable when the force is applied to the tackling bag.

15. The apparatus of claim 14, wherein the traveling pulley device is positioned between the second and third wheel housings.

16. The apparatus of claim 14, further comprising a magnet coupled to the rolling mechanism, wherein the rolling mechanism further comprises a metallic plate attached to the traveling pulley device, and wherein the magnet and the metallic plate are attached to each other thereby causing the traveling pulley device to be separated from the second cable.

17. The apparatus of claim 16, wherein the magnet is coupled to at least one of the second and third wheel housings of the rolling mechanism.

18. The apparatus of claim 16, wherein the force applied to the tackling bag causes the metallic plate and the magnet to detach from each other.

19. The apparatus of claim 11, wherein the first end of the first cable is fixed to the first support member of the pair of support members at a higher point than the second end of the first cable is fixed to the second support member of the pair of support members, and the first end of the third cable is fixed to the first support member of the pair of support members at a higher point than the second end of the third cable is fixed to the second support member of the pair of support members.

* * * * *